US010174491B2

(12) United States Patent
Pearson et al.

(10) Patent No.: US 10,174,491 B2
(45) Date of Patent: Jan. 8, 2019

(54) TOILET BOWL UNIT

(71) Applicant: Ideal Standard (UK) Limited, Hull Humberside (GB)

(72) Inventors: John Mark Richard Pearson, Hull Humberside (GB); Michael Ian Heaton, Hull Humberside (GB)

(73) Assignee: IDEAL STANDARD (UK) LIMITED, Hull Humberside (GB)

( * ) Notice: Subject to any disclaimer, the term of this patent is extended or adjusted under 35 U.S.C. 154(b) by 22 days.

(21) Appl. No.: 15/316,578

(22) PCT Filed: Jul. 20, 2015

(86) PCT No.: PCT/GB2015/052096

§ 371 (c)(1),
(2) Date: Dec. 6, 2016

(87) PCT Pub. No.: WO2016/009230

PCT Pub. Date: Jan. 21, 2016

(65) Prior Publication Data

US 2017/0183855 A1 Jun. 29, 2017

(30) Foreign Application Priority Data

Jul. 18, 2014 (GB) ..... 1412805.2

(51) Int. Cl.
*E03D 11/00* (2006.01)
*E03D 11/08* (2006.01)
(Continued)

(52) U.S. Cl.
CPC ..... *E03D 11/08* (2013.01); *E03D 11/02* (2013.01); *E03D 11/06* (2013.01); *E03D 2201/40* (2013.01)

(58) Field of Classification Search
CPC ..... E03D 11/02; E03D 11/06; E03D 11/08
(Continued)

(56) References Cited

U.S. PATENT DOCUMENTS 1,742,790 A 1/1930 Smith
2,212,538 A 4/1939 Groeniger
(Continued)

FOREIGN PATENT DOCUMENTS

CN 2818590 Y 9/2006
EP 0065452 A1 11/1982
(Continued)

OTHER PUBLICATIONS

International Preliminary Report on Patentability, Application No. PCT/GB2015/052096, dated Feb. 2, 2017, 10 pages.
(Continued)

*Primary Examiner* — Huyen Le
(74) *Attorney, Agent, or Firm* — Patterson Thuente Pedersen, P.A.

(57) ABSTRACT

A toilet bowl unit includes a toilet bowl with an inner toilet bowl surface having an upper peripheral portion, a central peripheral portion and a lower sump portion. A peripheral slot separates a lower edge of the upper peripheral portion from an upper edge of the central peripheral portion. A peripheral water channel is concealed inside the toilet bowl unit and has a side wall which is a weir over which water may flow into the peripheral slot. The slot has a discharge opening which is substantially horizontal at the rear and sides of the inner toilet bowl surface (for discharging a curtain of water) and includes at least one serpentine portion at the front of the inner toilet bowl surface (for discharging a jet of water). The horizontal portion(s) of the discharge opening are positioned just below a seat platform surface in order to minimize the unwashed area at the top of the inner toilet bowl surface.

19 Claims, 29 Drawing Sheets

(51) Int. Cl.
*E03D 11/02* (2006.01)
*E03D 11/06* (2006.01)

(58) Field of Classification Search
USPC ..... 4/420
See application file for complete search history.

(56) References Cited

U.S. PATENT DOCUMENTS

| | | | | |
|---|---|---|---|---|
| 2003/0140406 | A1* | 7/2003 | Miwa | E03D 11/02 4/420 |
| 2005/0115042 | A1* | 6/2005 | Davies | B28B 1/002 29/401.1 |
| 2013/0219605 | A1 | 8/2013 | Grover et al. | |

FOREIGN PATENT DOCUMENTS

| | | |
|---|---|---|
| GB | 440914 | 1/1936 |
| GB | 737194 | 9/1955 |
| WO | WO 2009/030904 A1 | 3/2009 |

OTHER PUBLICATIONS

International Search Report for corresponding International Application No. PCT/GB2015/052096 dated Oct. 16, 2015; 7 pages.
Written Opinion of the International Searching Authority for corresponding International Application No. PCT/GB2015/052096 dated Oct. 16, 2015; 8 pages.
Search and Examination Report for corresponding GB Application No. 1412805.2 dated Dec. 22, 2014; 6 pages.

* cited by examiner

TOILET BOWL UNIT

CROSS-REFERENCE TO RELATED APPLICATIONS

The present application is a National Phase entry of PCT Application No. PCT/GB2015/052096, filed on 20 Jul. 2015, which claims priority to GB Patent Application No. 1412805.2, filed on 18 Jul. 2014, which are hereby fully incorporated herein by reference.

TECHNICAL FIELD

The present disclosure is in the technical field of toilets and is particularly directed to an improved toilet bowl unit for a toilet.

BACKGROUND

When flushing a toilet, it is desirable to ensure that as much as possible of the inner surface of the toilet bowl is washed clean by the flushing water. It is also desirable to reduce the possibility for waste to remain hidden out of sight in the toilet bowl and that the toilet bowl should have an attractive appearance and be easy to clean.

For many years, the conventional toilet has had a rim channel which overhangs the toilet bowl and which discharges water downwards into the toilet bowl through an open-bottom chamber or holes in the bottom wall of the overhanging rim.

In an attempt to improve the flushing of the toilet bowl surface and to reduce the places where waste can hide out of sight, so-called "rimless" toilets have been proposed in recent years. An example is shown in WO2009/030904 (Ideal Standard), the disclosure of which is incorporated herein by reference.

Another example of a "rimless" toilet is shown in US2013/0219605 (AS IP Holdco, LLC), which shows an American version of a rimless toilet having a "sump jet" which discharges into the sump of the toilet bowl. The contents of US2013/0219605 are also incorporated herein by reference for aiding the technical understanding of the reader.

These prior art rimless toilets can still leave un-rinsed various portions of the inner toilet bowl surface that are not flushed in an effective manner by the water. In particular, the rear surface portion and the front top portion of the bowl may not be washed clean. Moreover, recent amendments to the EN standards (EN 997) allow for an unwashed circumferential strip running around the top edge of the bowl and having a depth of 85 mm below the upper rim surface of the "rimless" toilet.

A toilet bowl that is visually attractive, easy to clean and hygienic (without undercuts which are exposed to fecal matter) is also desirable, such as in the commercial market for toilets where a toilet may be used by members of the public. Examples of locations include hospitals, care homes, offices, schools and hotels.

SUMMARY OF THE DISCLOSURE

In accordance with an aspect of the disclosure invention, there is provided a toilet bowl unit comprising: a toilet bowl with an inner toilet bowl surface having an upper peripheral portion, a central peripheral portion and a lower sump portion; a peripheral slot which separates a lower edge of the upper peripheral portion from an upper edge of the central peripheral portion; and a peripheral water channel which is concealed inside the toilet bowl unit and has a side wall which is a weir over which water may flow into the peripheral slot.

The peripheral slot may be configured to discharge a "curtain" of water onto the inner toilet bowl surface for efficient and effective cleaning purposes.

In some embodiments, the peripheral water channel is located radially outwards of an outer toilet bowl surface of the toilet bowl.

For example, the toilet bowl unit may have an outer wall around at least the front and sides of the toilet bowl. This outer wall may give an attractive outer shape to the overall toilet bowl unit. The peripheral water channel may be located between the outer wall and the toilet bowl. Alternatively, if the wall of the toilet bowl is itself sufficiently thick, the peripheral water channel may be located in the thickness of the toilet bowl wall.

In some embodiments, the weir is located radially outwards of the outer toilet bowl surface of the toilet bowl.

In embodiments, the peripheral slot extends around at least 80%, 90%, 95% or 98% of the circumference of the inner toilet bowl surface. In one embodiment, the peripheral slot extends around 100% of the circumference. In other words, the peripheral slot is annular.

In embodiments, the peripheral slot faces downwards and radially inwards into the toilet bowl. Thus, the slot may guide or direct a curtain of water that exits the slot down onto the inner toilet bowl surface.

In embodiments, the lower edge of the upper peripheral portion is stepped radially inwards from the upper edge of the central peripheral portion by 1 to 10 mm. Advantageous ranges include 1 (or 2) mm to 9 mm, 8 mm, 7 mm, 6 mm, 5 mm, 4 mm or 3 mm. In one embodiment, the range is 2 to 5 mm. From a distance, this helps to ensure that the toilet bowl appears to have a smooth contour or shape for the inner toilet bowl surface. A small step inwards also helps to ensure that waste is less likely to be trapped unseen in the toilet bowl for a prolonged period of time between the routine regular manual cleaning of the toilet bowl. The cleaning is also made easier because the operative can easily see all parts of the inner toilet bowl surface.

In embodiments, the peripheral slot has a depth between a roof and a floor of the slot at the discharge opening of the slot of between 1 mm and 10 mm. In some embodiments, ranges are 2 mm (or 3 mm) to 10 mm, 9 mm, 8 mm, 7 mm, 6 mm, 5 mm or 4 mm. In one embodiment, the range for the depth of the slot is 3 mm to 5 mm.

In embodiments, the roof and the floor of the slot are generally parallel as the slot extends back from the discharge opening of the slot towards the peripheral water channel in a radially outwards and upwards direction.

In embodiments, the slot is angled at 20 to 35 degrees (for example, 25 to 30 degrees) relative to the horizontal.

In embodiments, the depth of the discharge opening of the slot at all measurement points around the periphery of the inner toilet bowl surface does not vary by more than plus or minus 3 mm from an average slot depth value. This helps to give the slot a substantially uniform visual appearance and to produce a substantially uniform curtain of water during flushing. The average slot depth value may be, for example, 4 mm. If the variation is limited to plus or minus 2 mm, 1 mm or 0.5 mm, the slot may be given an even more uniform and pleasing visual appearance.

In embodiments, the discharge opening of the peripheral slot is generally or substantially horizontal around at least 50% (or 60%, 70% or 80%) of the periphery of the inner toilet bowl surface (and is not horizontal, e.g. is serpentine, around substantially all of the rest of the periphery of the inner toilet bowl surface).

In embodiments, the discharge opening of the slot includes at least one local downward deflection (in the peripheral direction of the inner toilet bowl surface). The or each local downward deflection is preferably a serpentine downward deflection. It may be in the form of a lobe. Usually, the or each local downward deflection is positioned in the front half of the toilet bowl.

When the discharge opening of the slot is annular, the annulus of the discharge opening may comprise substantially horizontal portion(s) at the rear and the sides of the inner toilet bowl surface and serpentine portion(s) in the front half of the inner toilet bowl surface.

There may be a single local downward deflection which is, for example, positioned centrally at the front of the toilet bowl.

In embodiments, first and second local downward deflections of the discharge opening of the slot are positioned at the front of the toilet bowl on respective sides of the bowl. In one embodiment they are preferably symmetrically positioned relative to a front to rear axis of the toilet bowl.

In embodiments, at the or each local downward deflection of the discharge opening of the slot, a corresponding portion of the weir of the peripheral water channel has a (locally) reduced height (e.g. a substantially zero height). This helps to produce a local (high flow rate) stream in contrast to the curtain of water which issues from substantially horizontal portion(s) of the discharge opening. The portion of the weir with reduced height may comprise a gap in the weir between adjacent (full height) portions of the weir.

When the toilet bowl unit has two local downward deflections of the slot, the arrangement may be such that the two streams or jets of water produced by the local downward deflections collide in front of the sump and produce a plume which drops into the lower sump portion of the toilet bowl and provides the main motive energy for flushing out the sump.

In embodiments, the toilet bowl unit has a top surface which is a seat platform surface for supporting a toilet seat, and substantially horizontal portion(s) of the discharge opening of the peripheral slot are positioned 10 to 25 mm below the seat platform surface. This configuration helps to reduce the wall area above the slot which will not be washed by the flushing water. In embodiments, the range is 10 to 20 mm, 15 to 20 mm, or 18 to 20 mm. The value in one embodiment is 15 mm.

In embodiments, at the discharge opening of the slot, the upper edge of the central peripheral portion of the inner toilet bowl surface has a greater radius of curvature in the vertical plane than the lower edge of the upper peripheral portion.

This helps to guide the "curtain" of water which exits the slot so that the curtain holds onto the toilet bowl surface beneath the slot as the curtain of water flows down into the sump of the toilet bowl. Thus, the curtain of water is better able to wash clean the entire toilet bowl surface beneath the slot.

The radius of curvature of the upper edge of the central peripheral portion may be 5 to 15 mm (for example, 8 to 10 mm). The radius of curvature of the lower edge of the upper peripheral portion may be 1 to 4 mm (for example, 2 to 3 mm).

In embodiments, the toilet bowl unit comprises: a base unit which provides the central peripheral portion and the lower sump portion of the inner toilet bowl surface; and a top unit which provides the upper peripheral portion of the inner toilet bowl surface; wherein the top unit is joined to the base unit and the peripheral water channel is provided between the top unit and the base unit. This makes it easier to manufacture the toilet bowl unit. The base unit and the top unit or cover may be separately molded and then joined together in the manufacturing process.

The peripheral water channel may be formed as an (annular) trough in the top surface of the base unit. The peripheral water channel may then be closed or covered by the top unit.

In embodiments, the top unit comprises a plate having an aperture surrounded by a downwardly-depending annular wall which provides the upper peripheral portion of the inner toilet bowl surface.

In embodiments, the area of the plate is substantially coterminous with the area of the top of the base unit.

The downwardly-depending annular wall may include one or more lobes (at each position where a stream of water is required to issue from the slot). For example, the downwardly-depending annular wall may include two front lobes. These lobes are symmetrically positioned on respective sides of the aperture of the plate in one embodiment.

The side wall (weir) of the peripheral water channel may include a plurality of circumferentially spaced-apart supports which support the underside of the plate of the top unit. The size and shape of the supports may be chosen so that the curtain water flowing over the weir and out of the slot does not have noticeable breaks in the curtain when the curtain exits the slot. At each opening in the weir wall (for allowing a stream or jet of water to discharge from the slot), a support may be provided on the weir wall at each side of the opening. The supports may be molded into the base unit during the manufacturing process.

In embodiments, an inlet at the rear of the toilet bowl unit communicates with a manifold which communicates with two arms of the peripheral water channel. The arms may extend around the toilet bowl on respective sides of the toilet bowl and join together at the front of the toilet bowl. Alternatively, distal (front) ends of the arms may be separated by a (small) gap at the front of the toilet bowl. The water which flows over the weir at the front ends of the arms may be arranged to combine together so that an uninterrupted curtain of water issues from the slot at the front centre of the toilet bowl.

In embodiments, the depth of the lobe(s) and associated weir opening(s) is such that, at the end of a flushing cycle, they let air back into the peripheral water channel and partially or entirely drain the water out of the rear inlet.

In embodiments, the floor of the peripheral water channel is substantially horizontal in the circumferential direction of the toilet bowl.

BRIEF DESCRIPTION OF THE DRAWINGS

Embodiments of the disclosure will now be described, by way of example only, with reference to the accompanying drawings.

Figure 1:
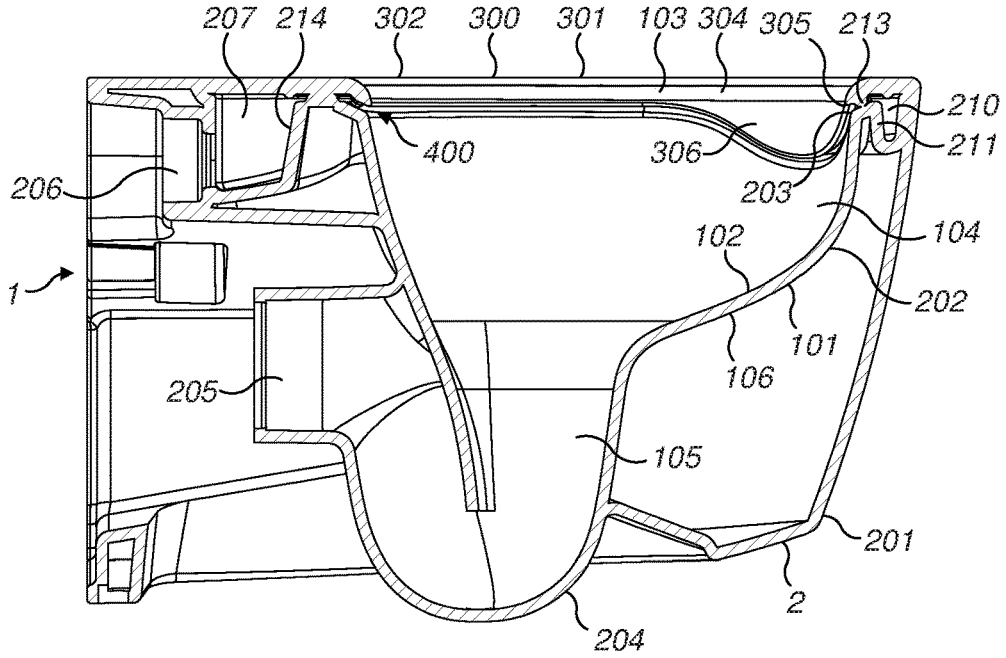
FIGS. 1 to 3 show a left half of a toilet bowl unit of a first embodiment in side view, rear perspective view and front perspective view.
Figure 2:
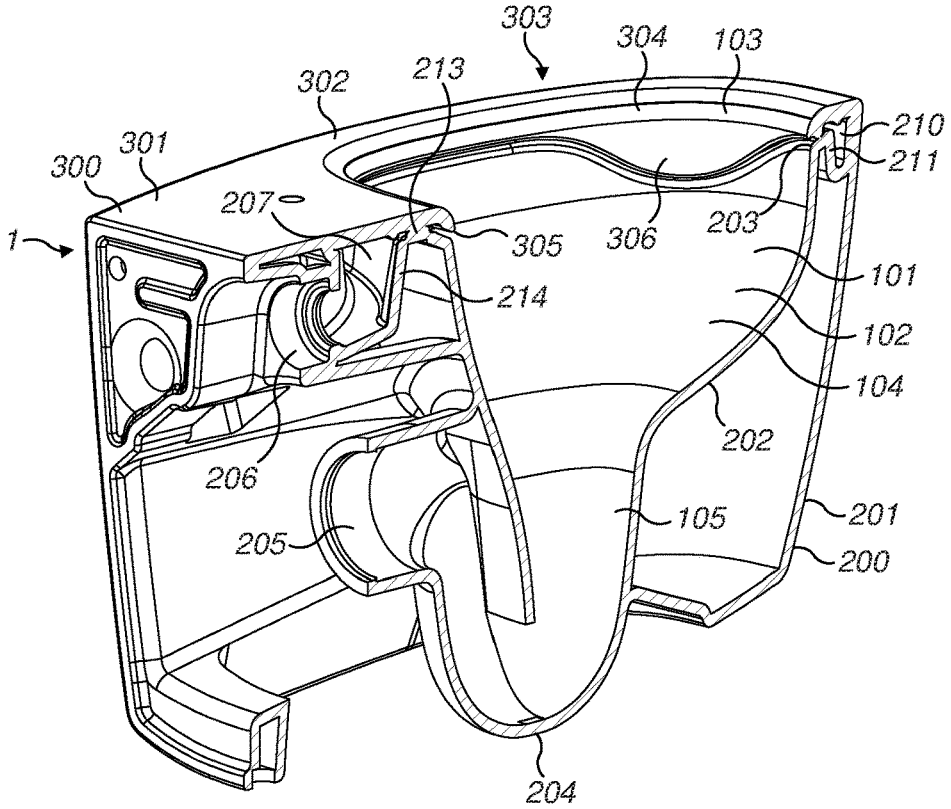
Figure 3:
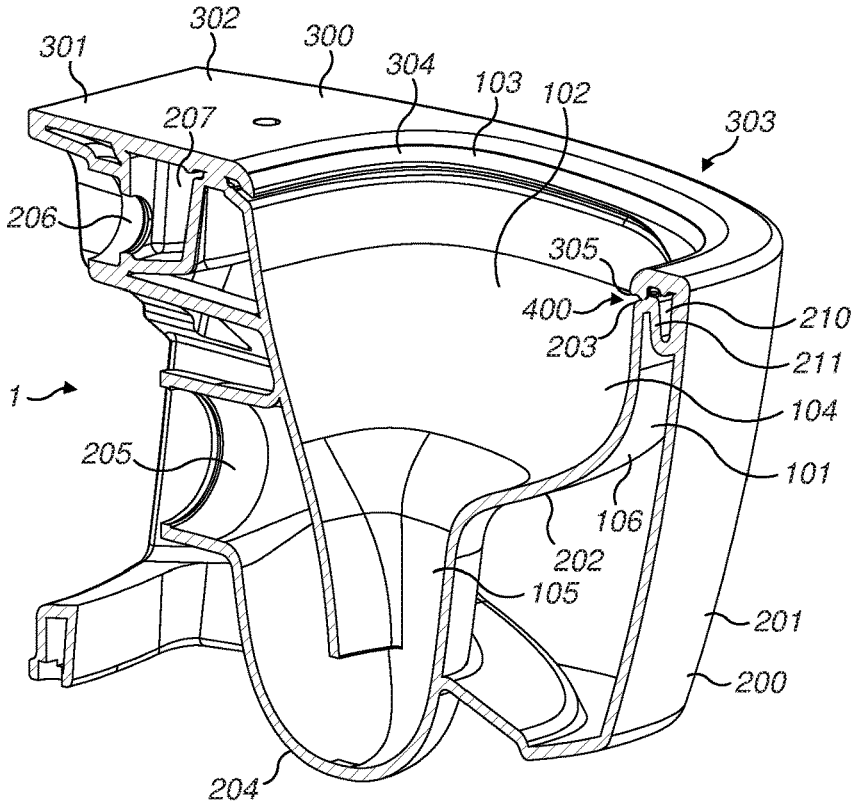
Figure 4:
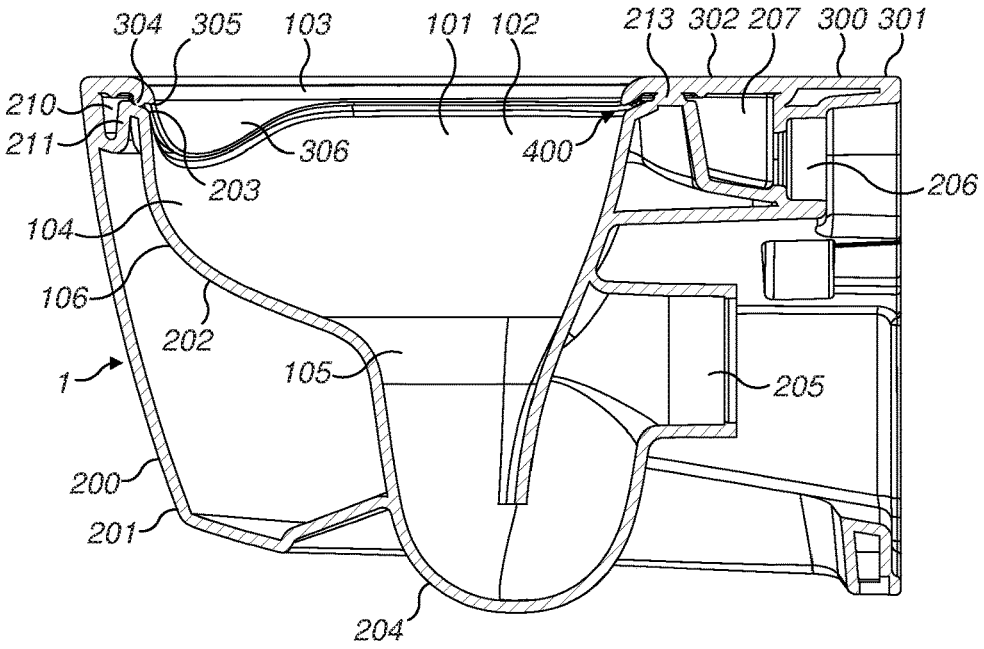
FIGS. 4 to 6 show a right half of the toilet bowl unit in side view, rear perspective view and front perspective view.
Figure 5:
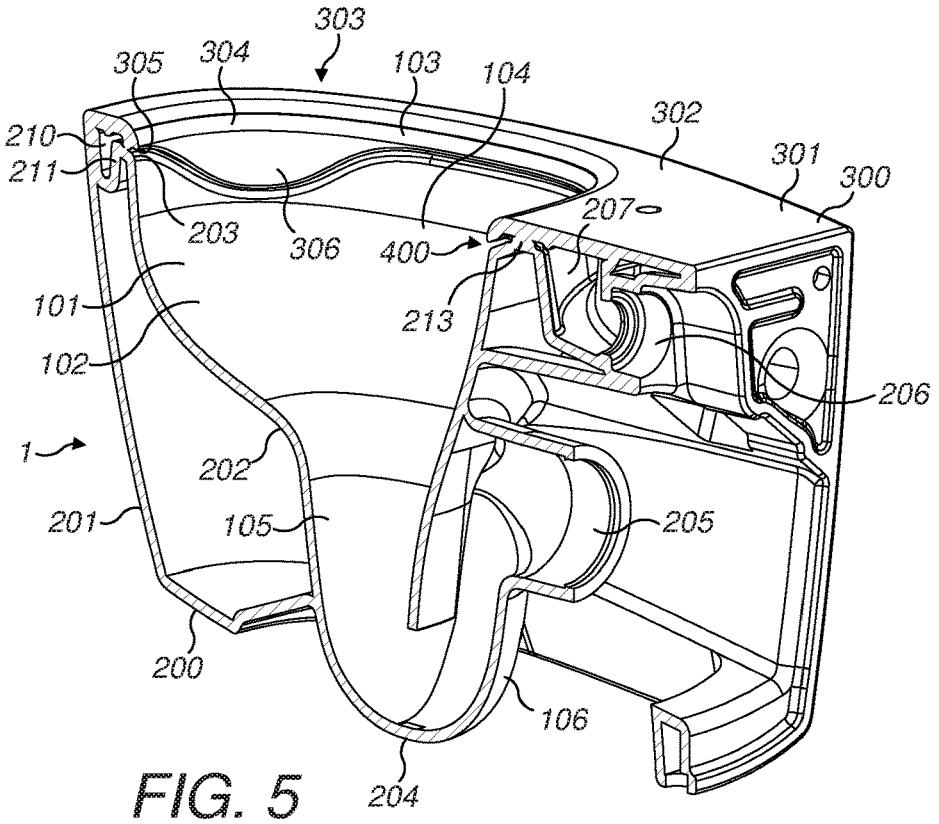
Figure 6:
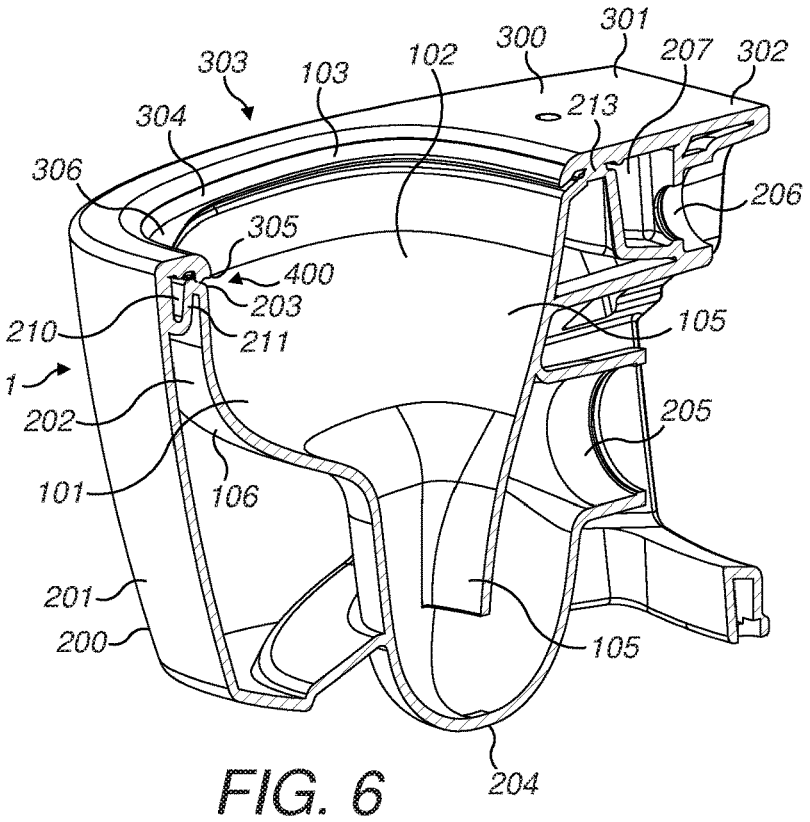
Figure 7:
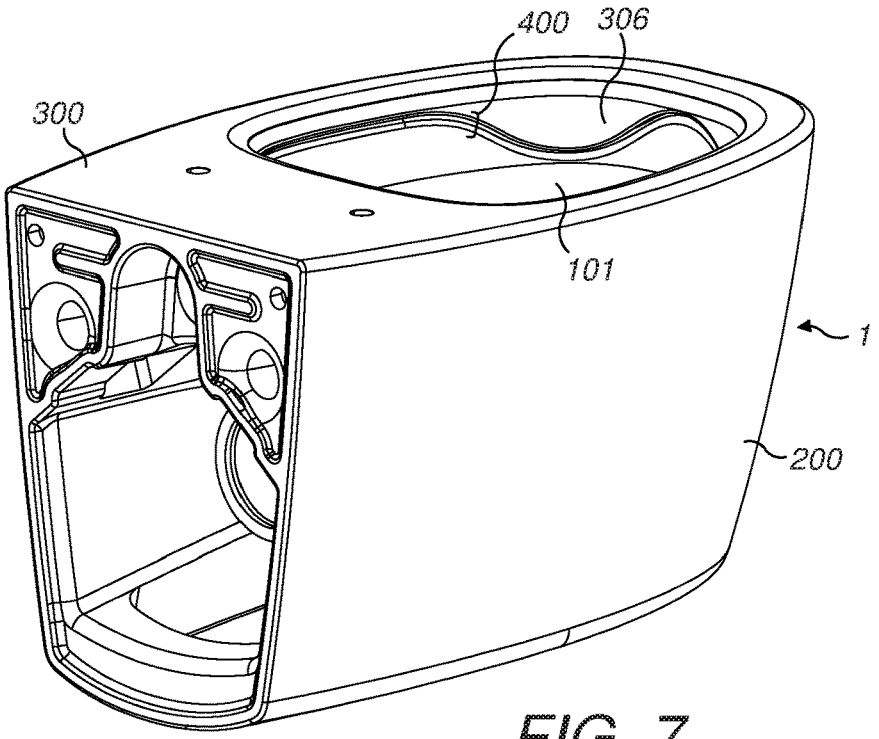
FIGS. 7 to 13 show the whole toilet bowl unit in rear perspective view, front perspective view, rear view from above, side view, other side view, front view and rear view.
Figure 8:
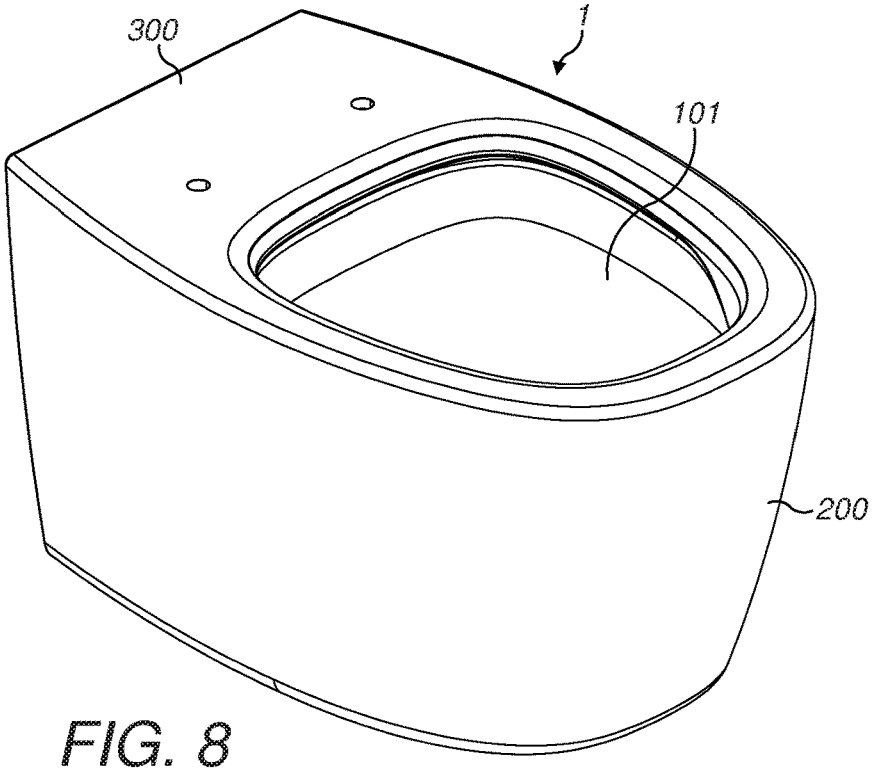
Figure 9:
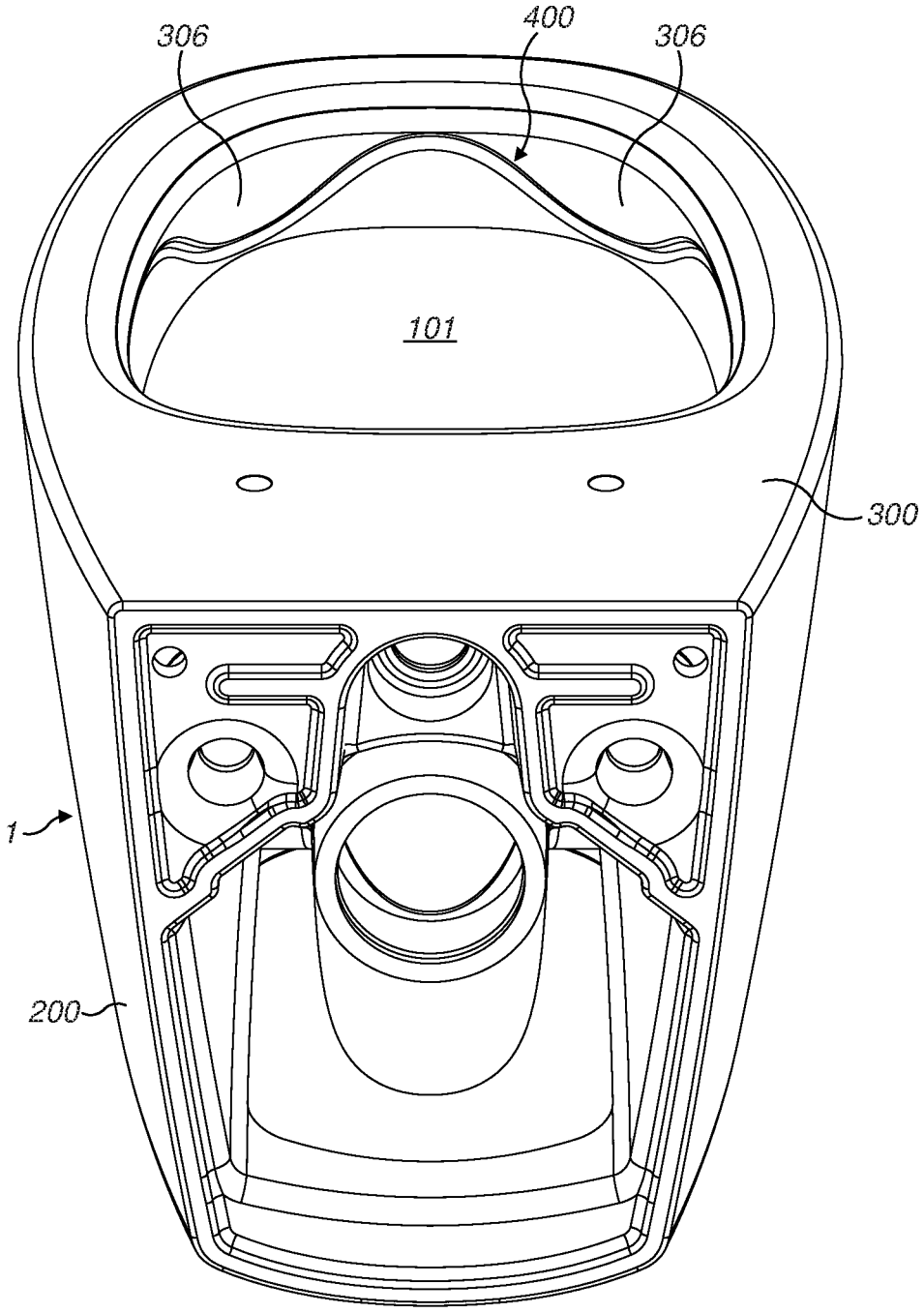
Figure 10:
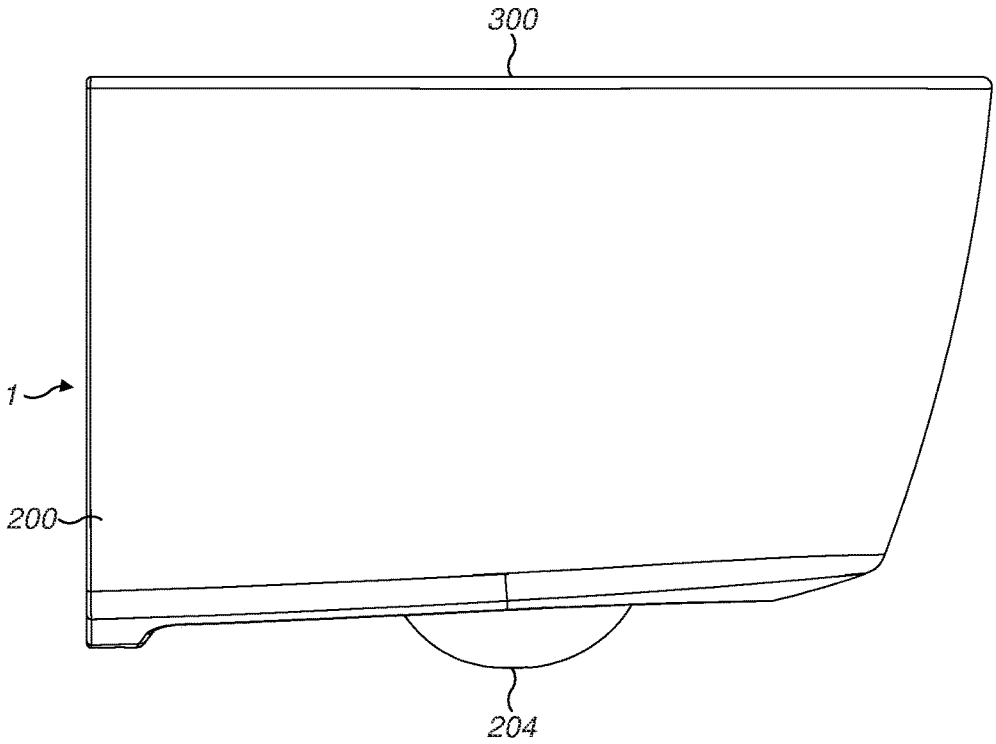
Figure 11:
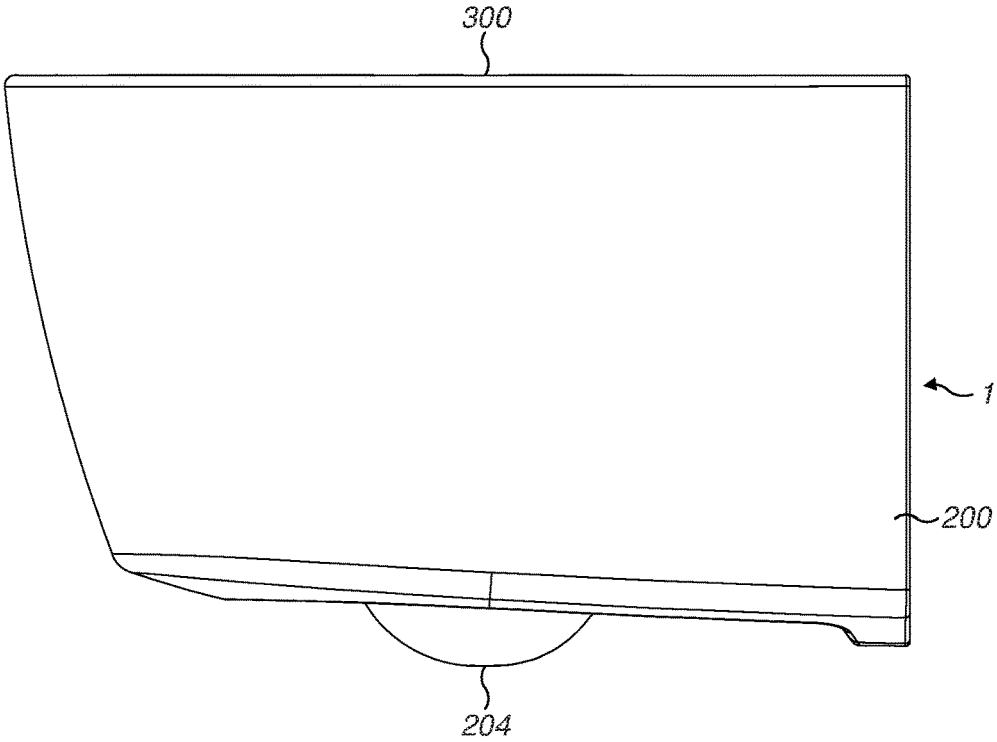
Figure 13:
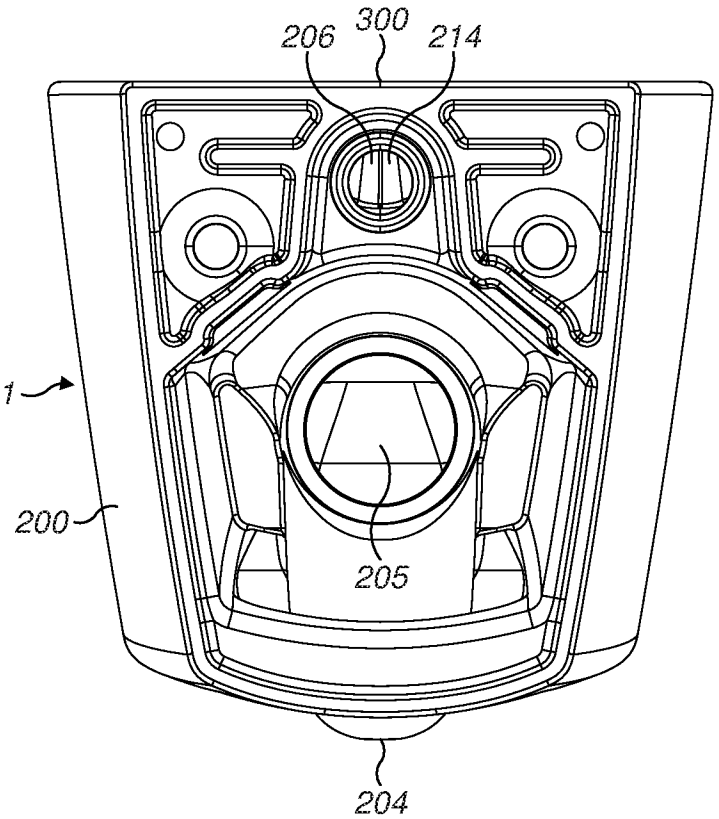
Figure 12:
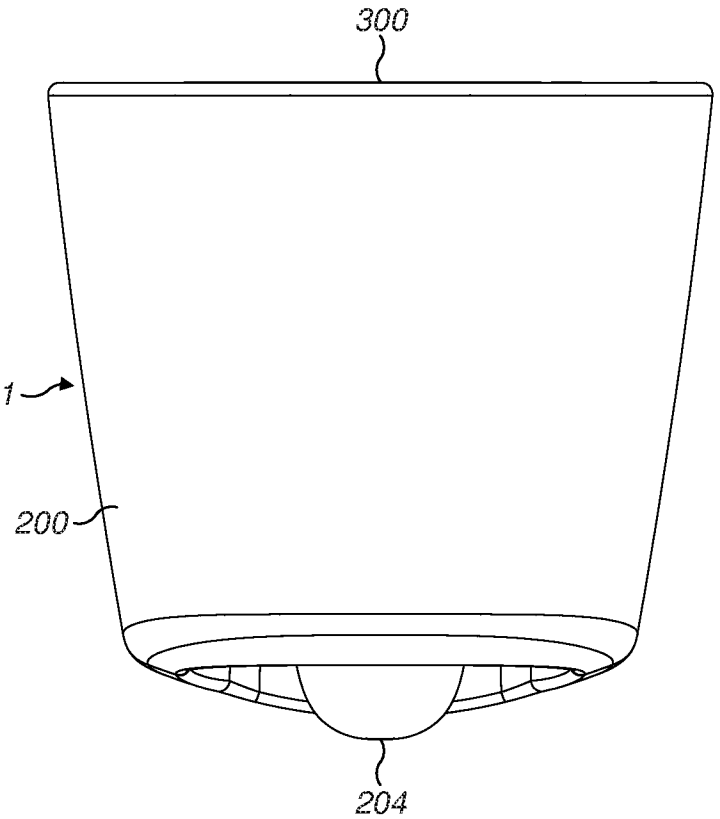
Figure 14:
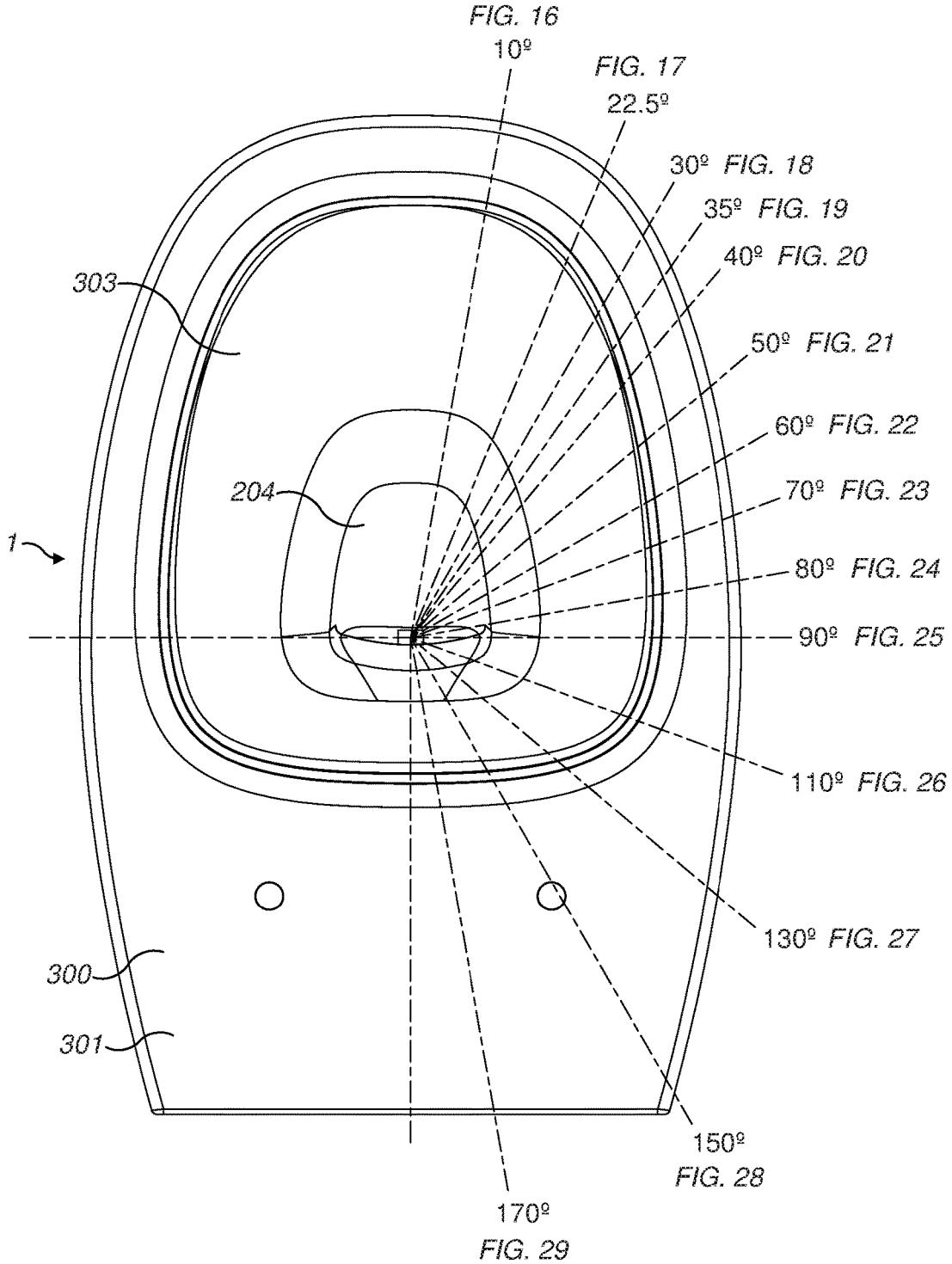
FIG. 14 is a plan view of the toilet bowl unit and shows the cutting lines for the sectional views of FIGS. 16 to 29.
Figure 15:
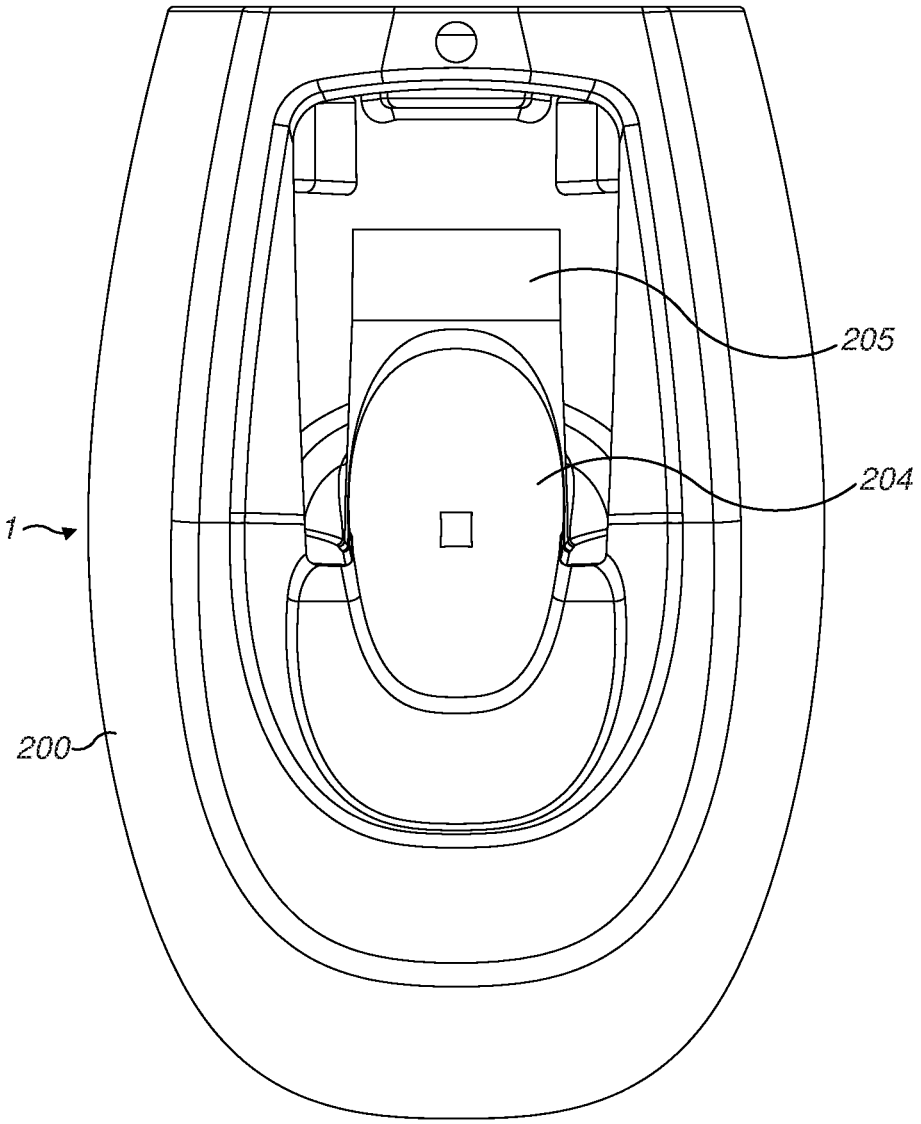
FIG. 15 is an underneath plan view of the toilet bowl unit.

While the invention is susceptible to various modifications and alternative forms, specific embodiments are shown by way of example in the drawings and are herein described in detail. It should be understood, however, that the drawings and detailed description thereof are not intended to limit the invention to the particular form disclosed but, on the contrary, the invention is to cover all modifications, equivalents and alternatives falling within the spirit and scope of the present disclosure as defined by the appended claims.

DETAILED DESCRIPTION

An embodiment of a toilet bowl unit in accordance with the present disclosure is shown in the Figures. The toilet bowl unit 1 as illustrated is of the wall-mounted type, but the present disclosure may be applied to any type of toilet including to floor-mounted toilets (pedestal toilets). Also, the toilet bowl unit 1 as illustrated is of the "European" type in that it does not have a "sump jet", but the present disclosure may be applied to any type of toilet including siphonic (e.g. "American") type toilets which do have a "sump jet".

The toilet bowl unit 1 is illustrated prior to a toilet seat being fitted to the top of the unit 1 and prior to the unit 1 being connected to a source of water such as a tank and prior to the sump outlet being connected to a sewer or the like. These actions would be performed in order to produce a working toilet.

The toilet bowl unit 1 can be made using standard chinaware materials and techniques. Molds are used to form a base unit 200 and a top unit 300 and these two components are joined together during the manufacturing process to form the final toilet bowl unit 1 as a one-piece product.

The toilet bowl unit 1 includes a toilet bowl 101 having an inner toilet bowl surface 102 which may be considered as being divided in the vertical direction into an upper annular portion 103, a central annular portion 104 and a lowermost sump portion 105.

The base unit 200 comprises an outer wall 201 which is generally U-shaped in horizontal cross-section and which is positioned around an inner toilet bowl wall 202. The inner surface of the toilet bowl wall 202 provides the central portion 104 and the lowermost sump portion 105 of the overall inner toilet bowl surface 102. The outer surface of the toilet bowl wall 202 provides an outer toilet bowl surface 106.

The top unit 300 comprises a plate 301 which sits on top of and is joined to the top of the base unit 200. The top unit 300 has a top surface 302 onto which a toilet seat may be fitted and a central aperture 303 which supports a downwardly-projecting annular wall 304 which projects down below the level of the plate 301. The annular inner surface of the wall 304 provides the upper portion 103 of the overall inner toilet bowl surface 102.

An annular lower edge 305 of the wall 304 is spaced above and slightly radially inwards of a corresponding shaped upper annular edge 203 of the toilet bowl wall 202 at the top of the central portion 104.

Thus there is an annular slot 400 defined between the top unit 300 and the base unit 200 between the edge 305 and the edge 203.

The rear and the sides of the slot 400 are horizontal, but at the front of the toilet bowl 101 the slot 400 has a sinuous or serpentine form at two positions. The horizontal portions of the slot 400 are arranged to produce a generally uniform curtain of water during a flushing operation, and the serpentine portions are arranged to produce two streams or jets. The curtain of water serves to wash clean the inner toilet bowl surface 102. The two streams collide and produce a plume of water which is intense enough to flush away the contents in a sump 204. The flushed waste then exits the toilet bowl unit 1 via a sump outlet 205.

The base unit 200 has a rear inlet 206 for receiving flushing water such as from a tank or cistern. The inlet 206 leads to a manifold 207 which splits the water into two flows and directs the flows into two semi-circular arms 208, 209 of an annular water channel 210 which is concealed inside the toilet bowl unit 1 by virtue of the top unit 300 having been fitted as a lid or cover onto the top of the base unit 200 during the manufacturing process.

The annular water channel 210 is shaped like a trough and its annular floor is generally horizontal. It is radially outwards of the outer toilet bowl surface 106 and is positioned between the toilet bowl wall 202 and the outer wall 201 of the base unit 200. A radially inner side wall 211 of the channel 210 functions as a weir because, during flushing, water spills over the top of the wall 211 and flows radially inwards and downwards through the slot 400 to enter the toilet bowl 101 as a curtain of water.

Figure 31:
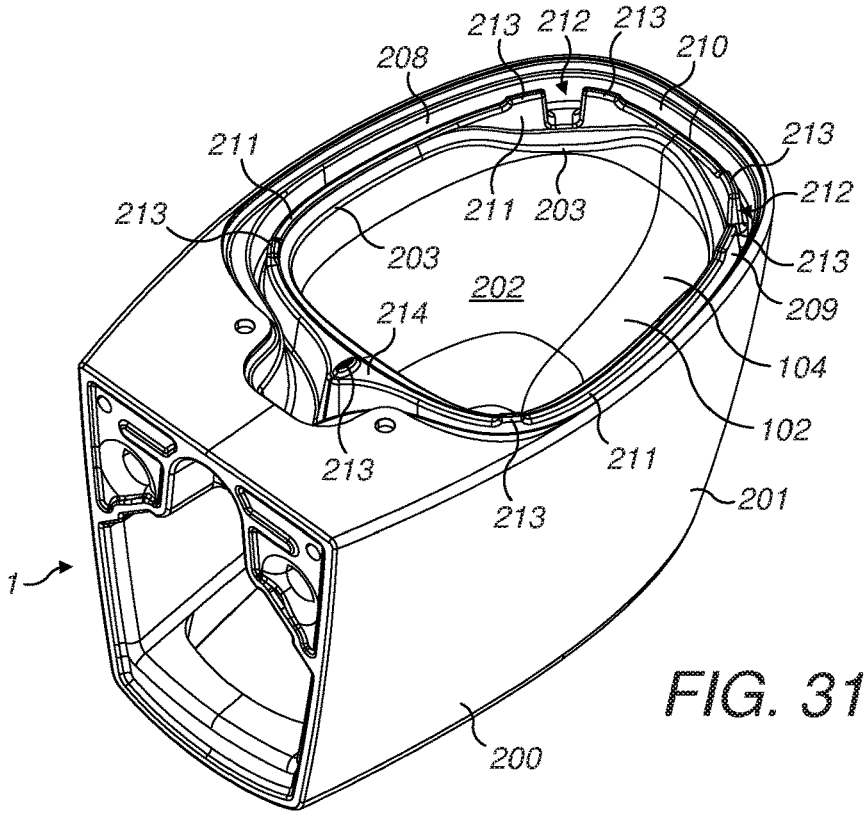
Figure 32:
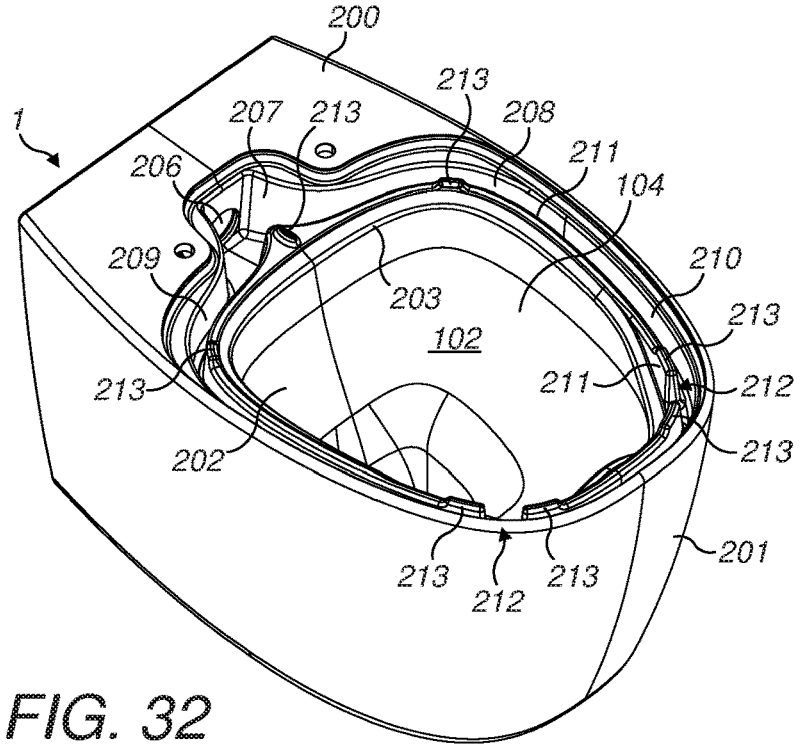
Figure 33:
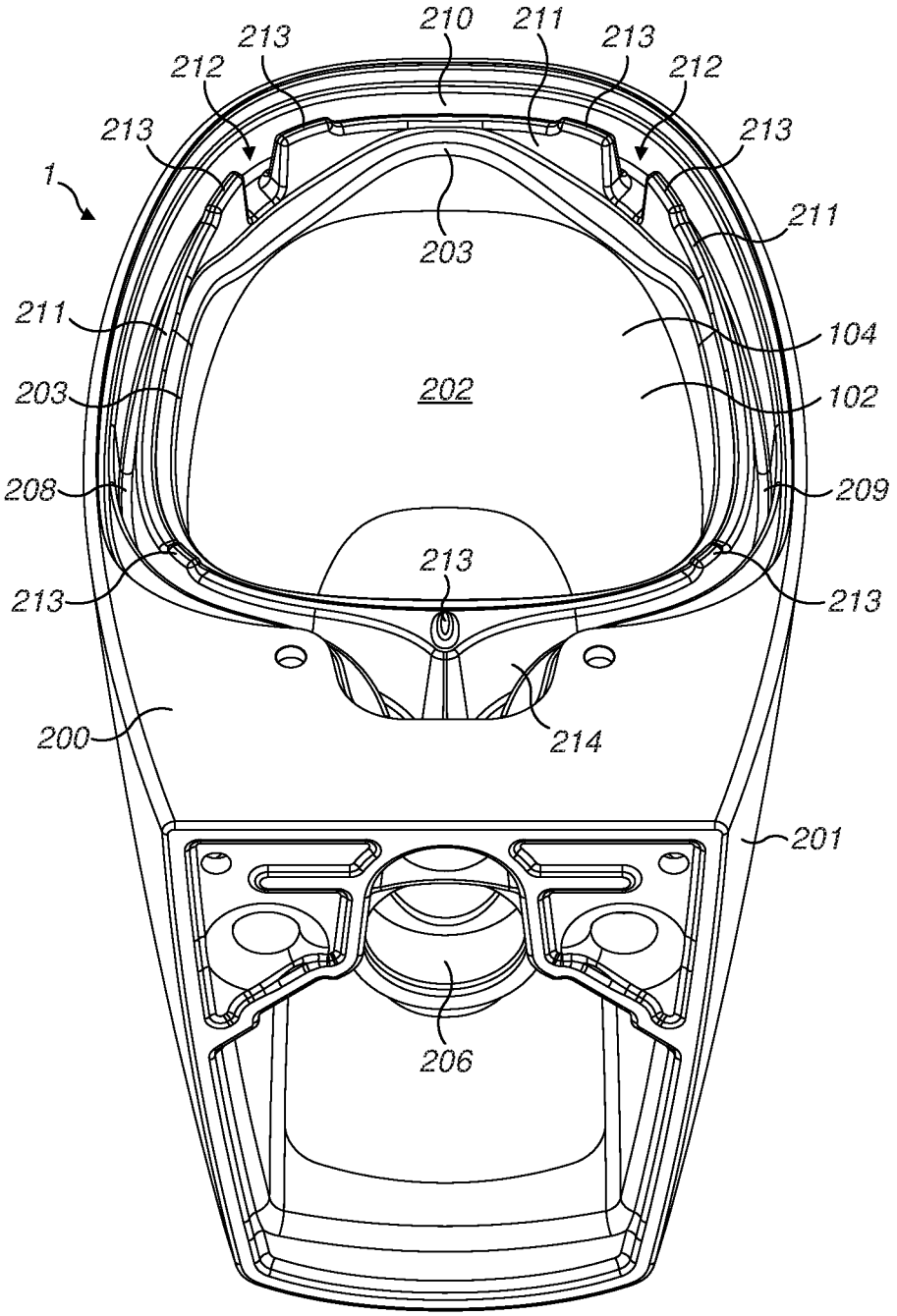
Figure 34A:
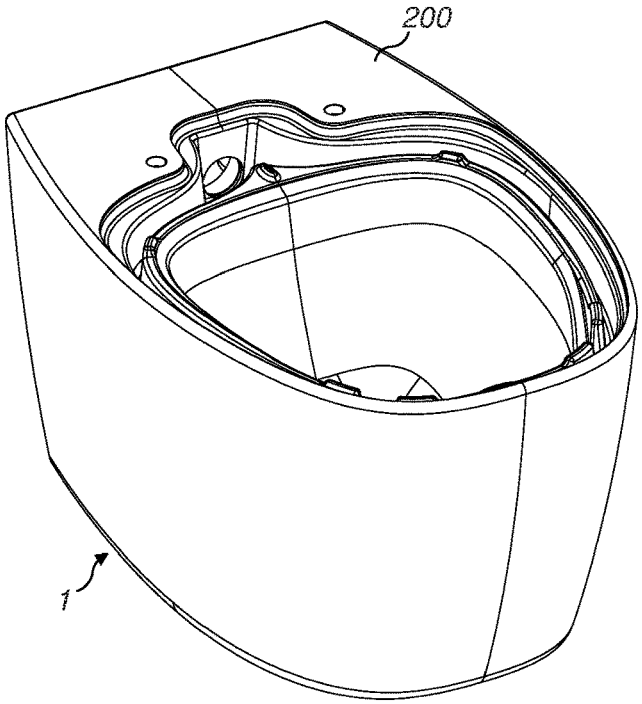
FIGS. 34A and 34B show the base unit in perspective and plan view so as to show more clearly the locations of the supports or upright projections on the weir wall which support the underside of the top unit.
Figure 34B:
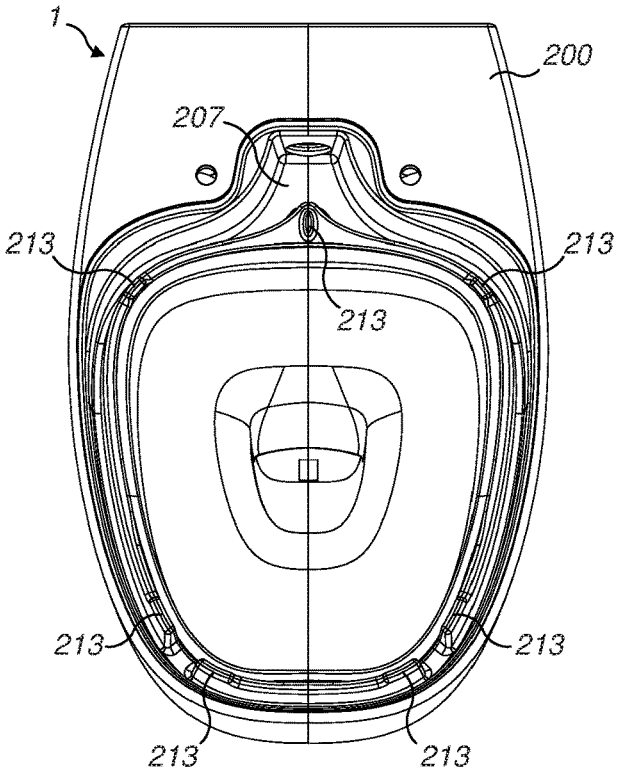

The wall 211 has two openings or gaps 212 (see FIGS. 31 to 33) at the front of the toilet bowl 101. The openings 212 extend down to the floor level of the channel 210 and are symmetrically positioned on respective sides of the toilet bowl unit 1 relative to a front to rear longitudinal axis of the toilet bowl unit 1.

The openings 212 produce streams or jets of water during flushing, as will be explained in more detail later. The two streams pass through the slot 400 but are more powerful than the curtain of water which exits the horizontal portions of the slot 400.

Supports 213 project upwards from the wall 211 above the level of the horizontal top or weir surface of the wall 211 and support the underside of the plate 301. The Figures show seven supports 213. At the front of the toilet bowl 101 there are four supports 213, with two supports 213 being positioned on respective sides of each of the two openings 212. Thus, each opening 212 is defined between two supports 213. At the rear of the toilet bowl 101 there are three supports 213, including a central support 213 which is positioned on top of a central splitter portion 214 of the wall 211 which helps the manifold 207 to split the incoming water into two flows for the water channel arms 208, 209. The central rear support 213 is shaped so as not to impede excessively the water flowing over the splitter 214 to form the water curtain at the rear of the toilet bowl 101.

Figure 36A:
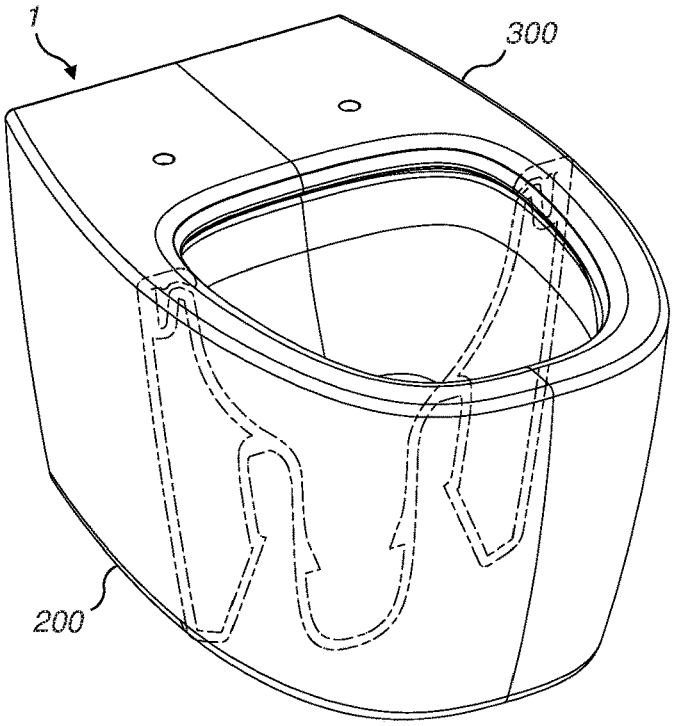
FIGS. 36A, 36B and 36C show the water channel at a position where the water discharge slot is horizontal and is arranged to produce a curtain of water and are a perspective view, a perspective sectional view and an enlarged sectional view.
Figure 36B:
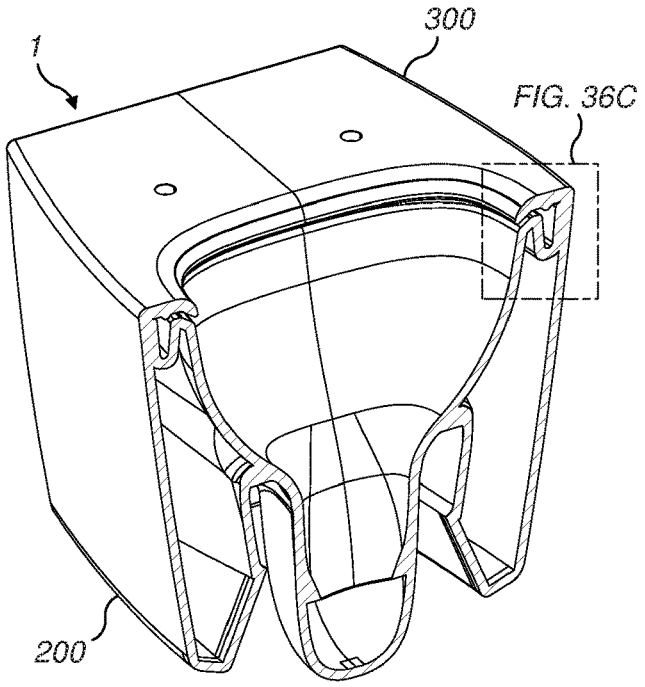
Figure 36C:
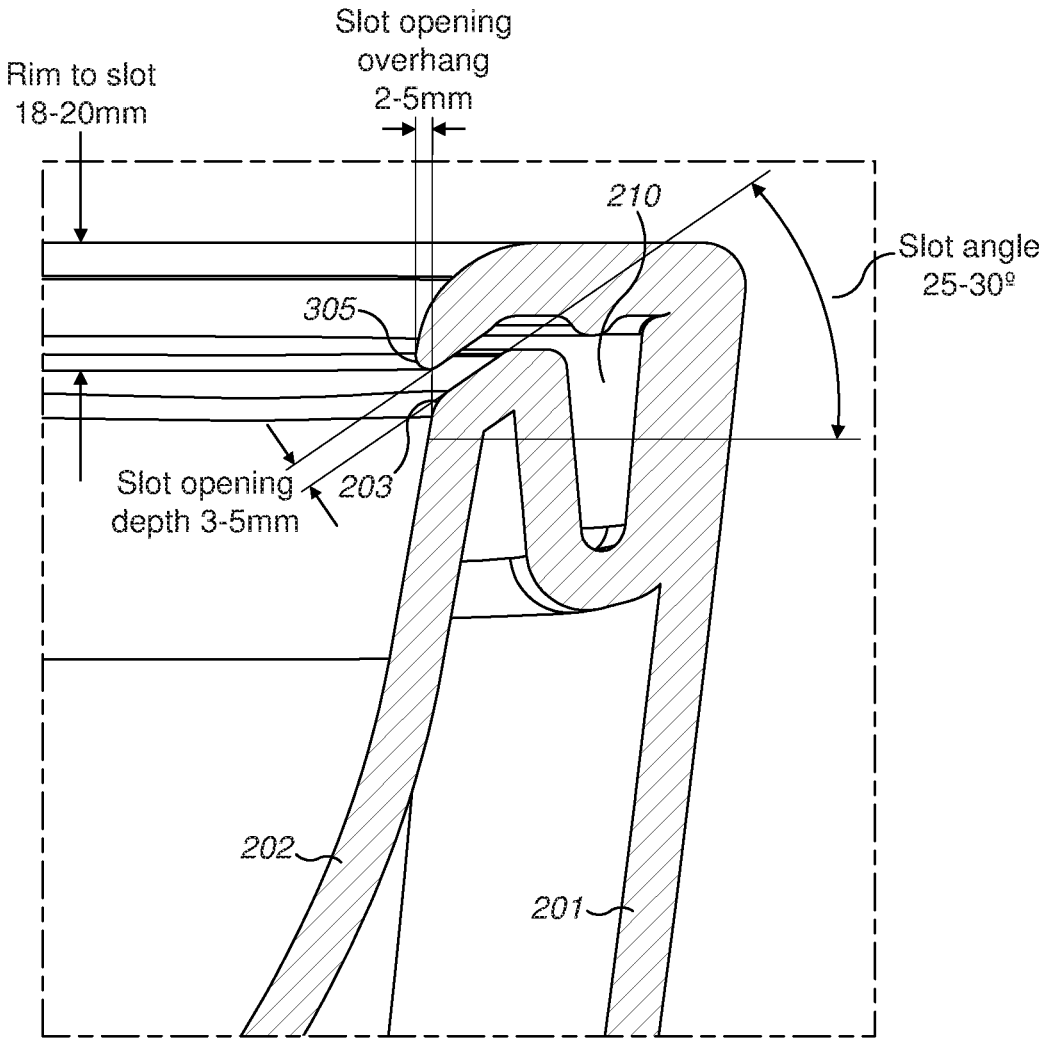

The openings 212 are hidden from view because the wall 304 of the top unit 300 includes two front lobes 306 which project down below the level of the horizontal side and rear portions of the wall 304. The lobes 306 are symmetrically positioned on the two sides of the toilet bowl 101 and the lower edge 305 at the lobes 306 is serpentine so as to give the slot 400 an aesthetically pleasing appearance. The wall 304 does include a horizontal front portion between the lobes 306 but this portion is of short length and the two lobes 306 effectively appear to blend into one another.

Where the lobes 306 are not present, and where the water simply flows from the channel 210 and over the top of the weir wall 211 (e.g. as in FIGS. 21 to 29), the roof and floor of the slot 400 are generally parallel and form a passageway that is usually at an angle of 25 to 30 degrees to the horizontal (see FIG. 36C).

Figure 35A:
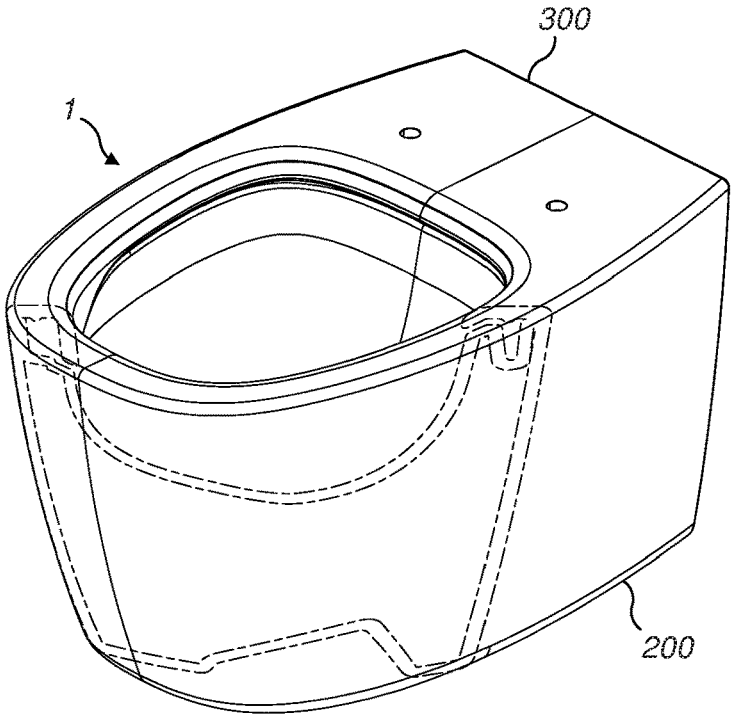
FIGS. 35A, 35B and 35C show the water channel and a lobe of the toilet bowl unit and are a perspective view, a perspective sectional view and an enlarged sectional view.
Figure 35B:
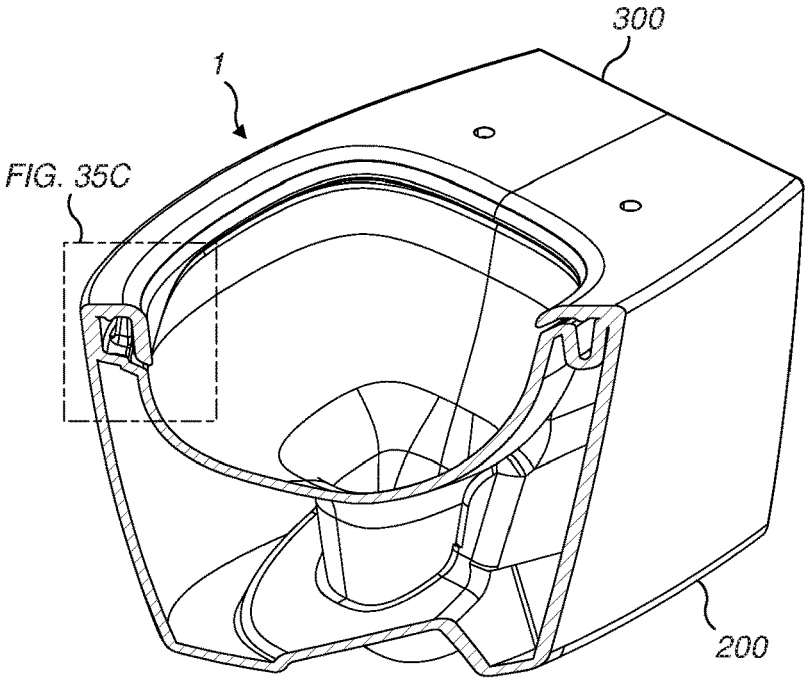
Figure 35C:
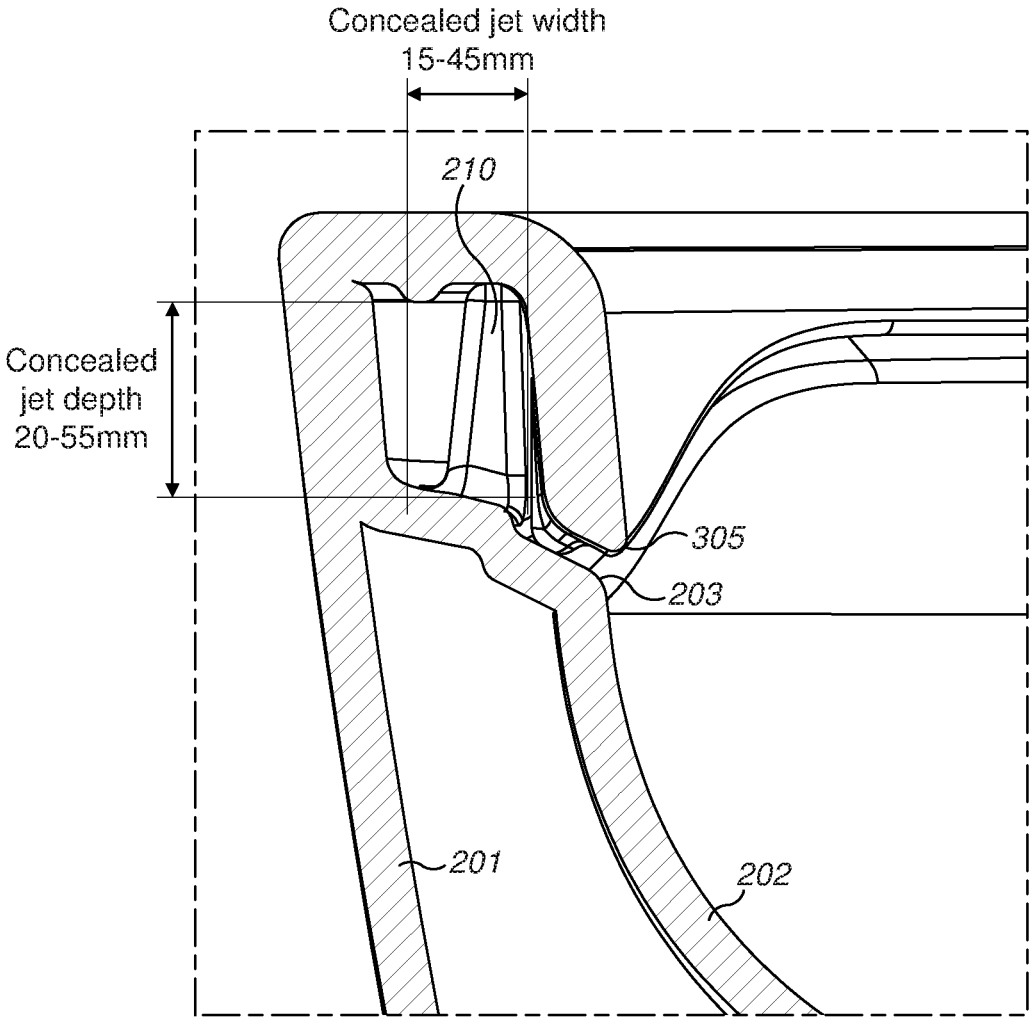

At the center of a lobe 306 (see FIG. 35C), the water flows from the channel 210 through an opening 212 and into a lowermost part of the slot 400 where, again, the roof and the floor of the slot 400 are generally parallel and form a passageway that slopes downwards and radially inwards into the toilet bowl 101.

Figure 16:
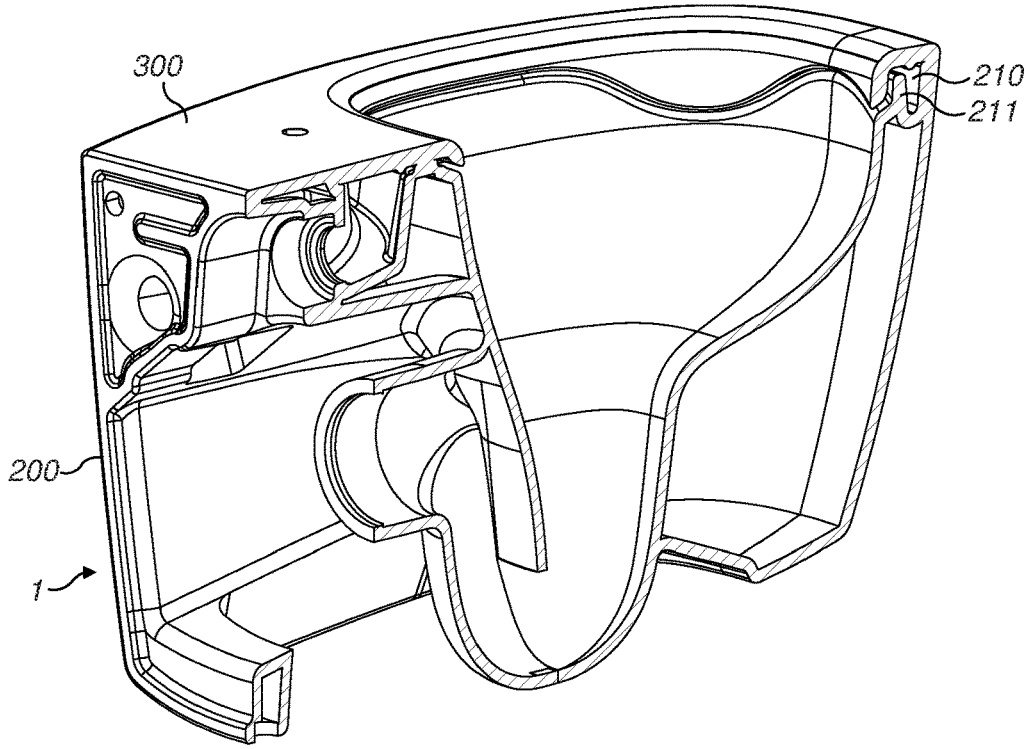
FIGS. 16 to 29 are sectional views of the toilet bowl unit.
Figure 17:
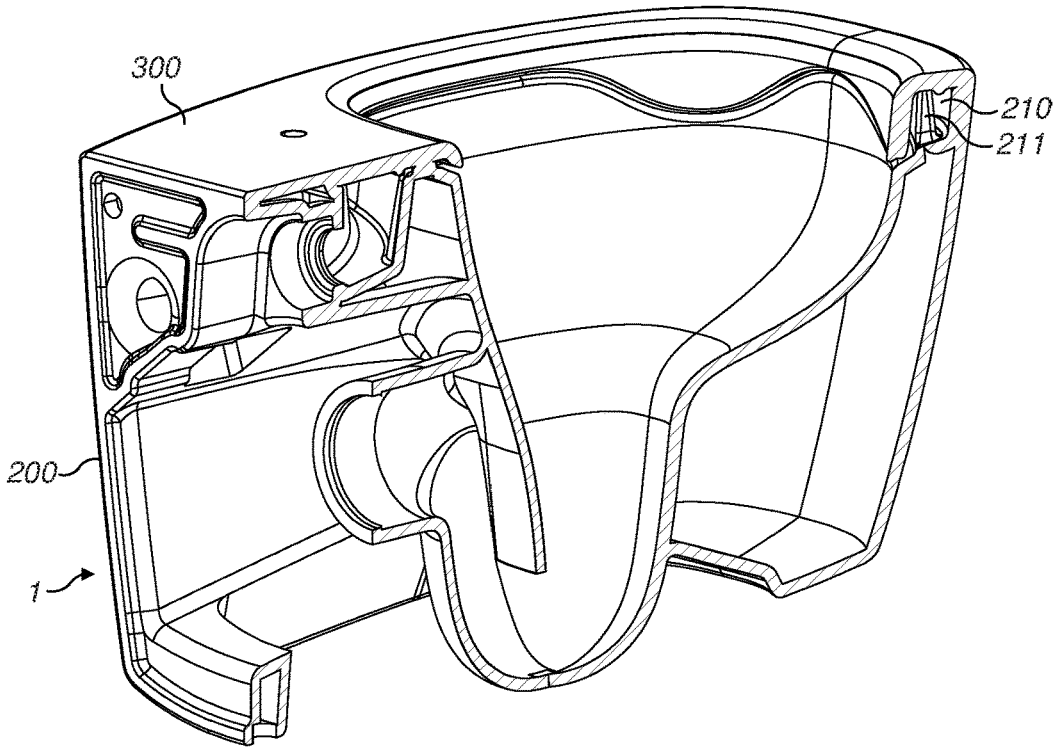
Figure 18:
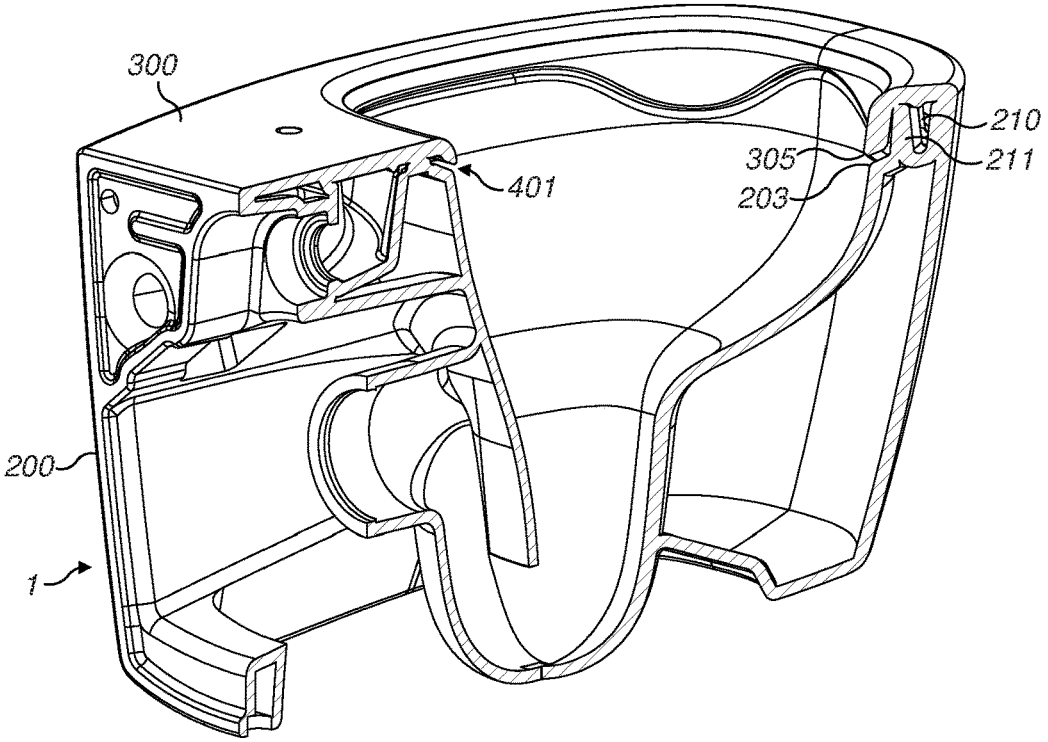
Figure 19:
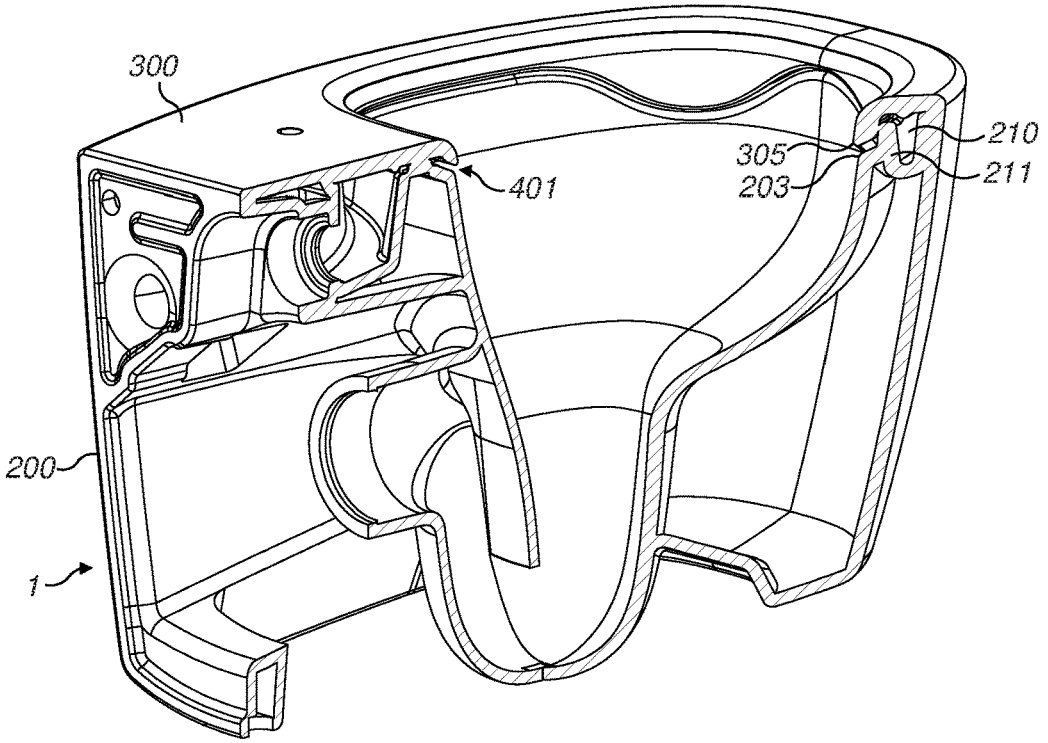
Figure 20:
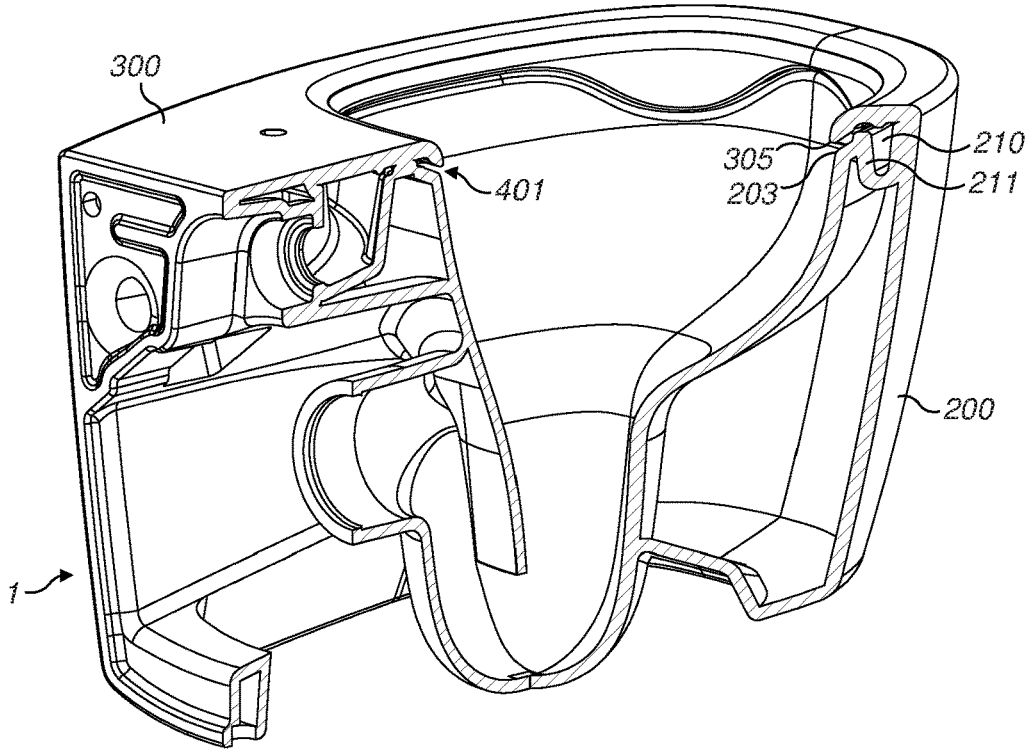
Figure 21:
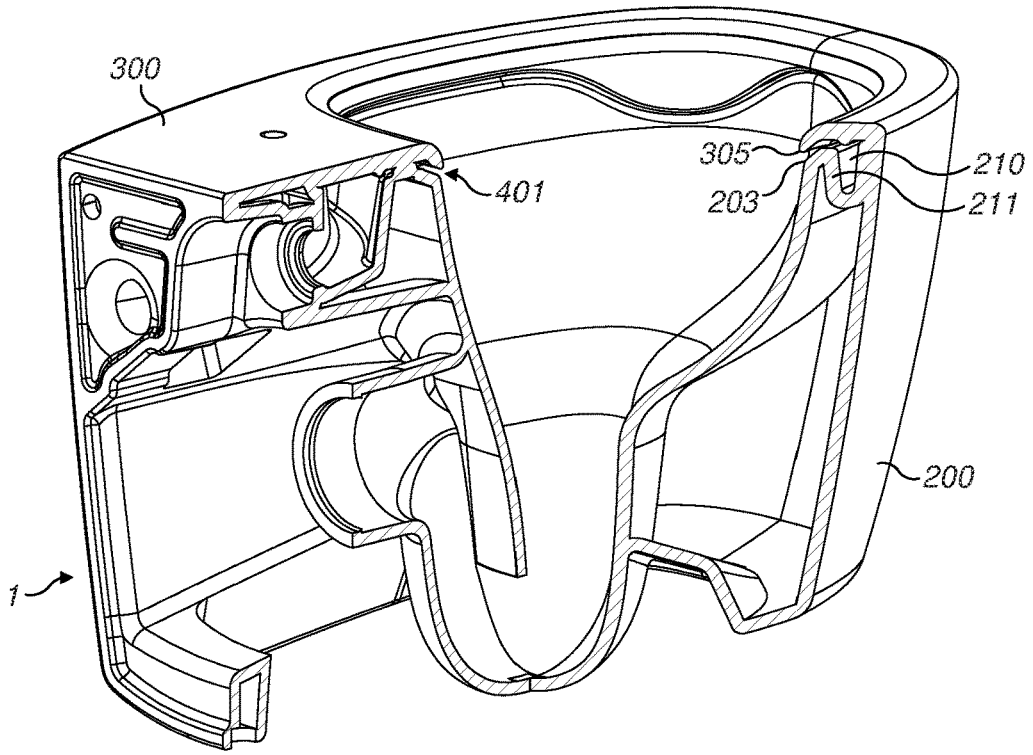
Figure 22:
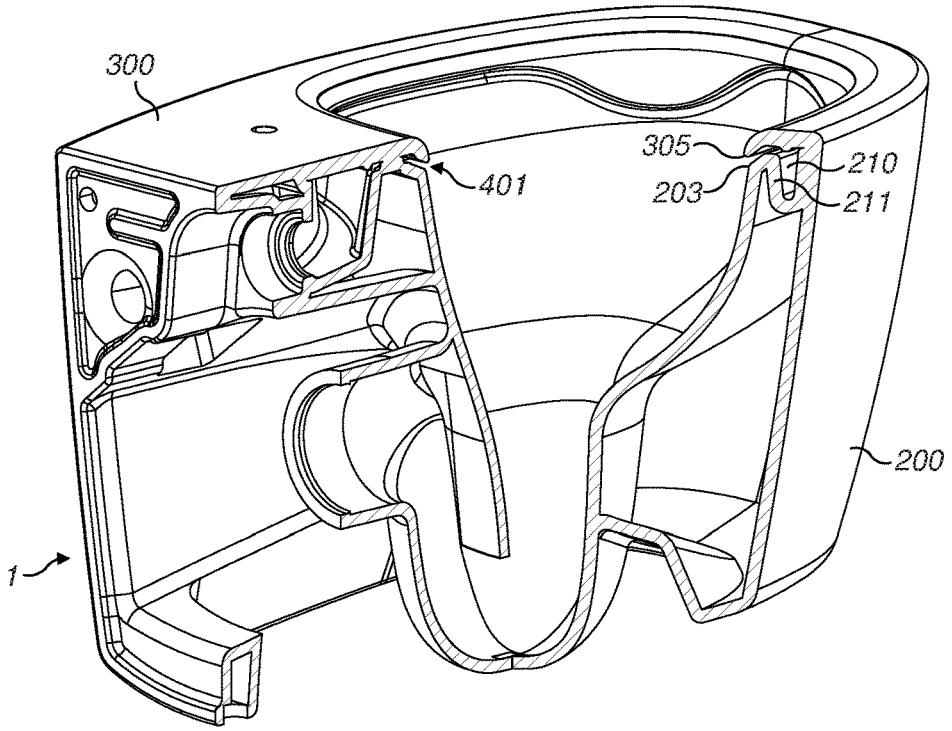
Figure 23:
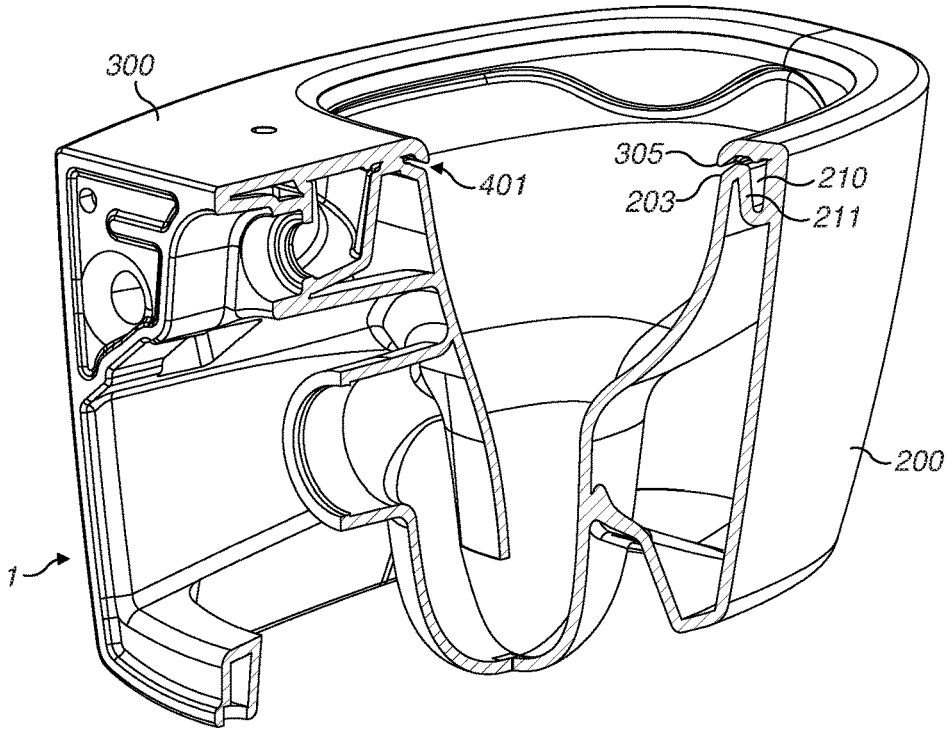
Figure 24:
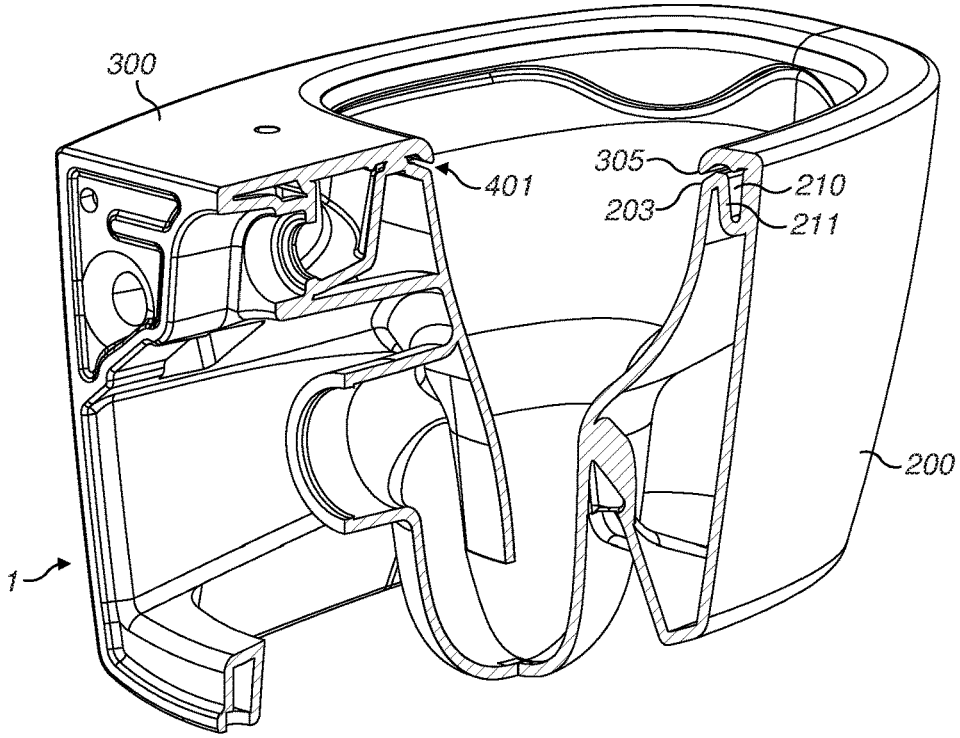
Figure 25:
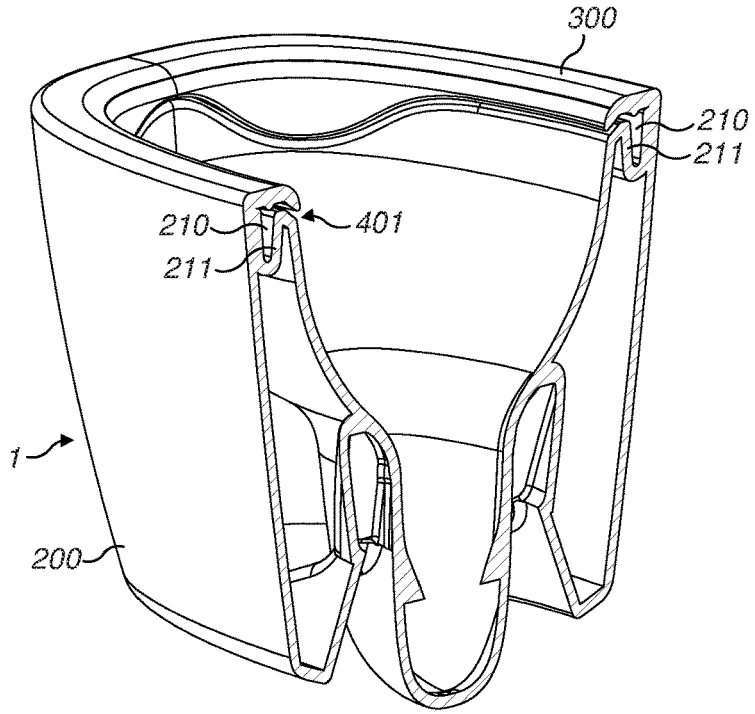
Figure 26:
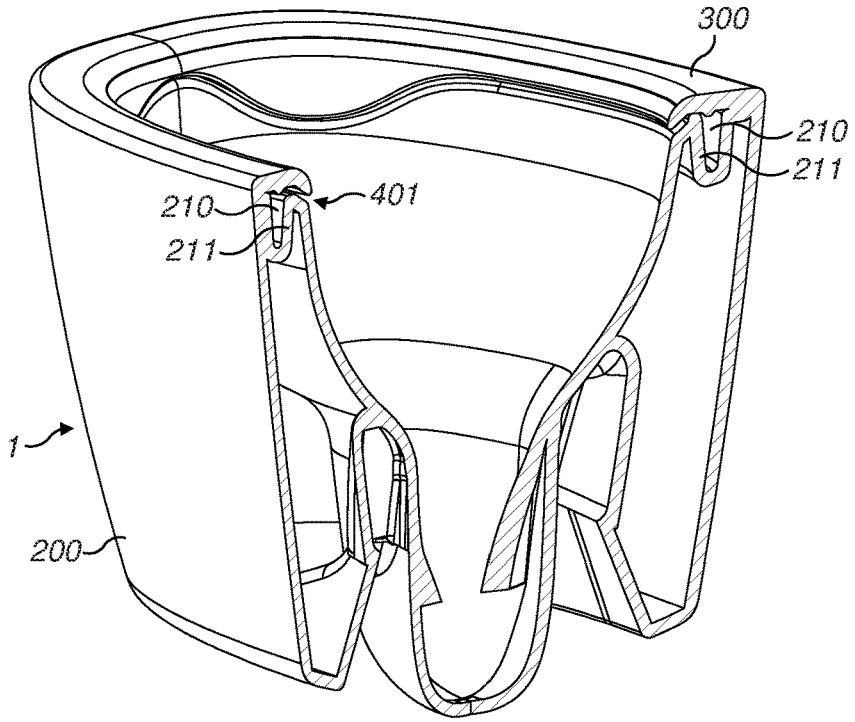
Figure 27:
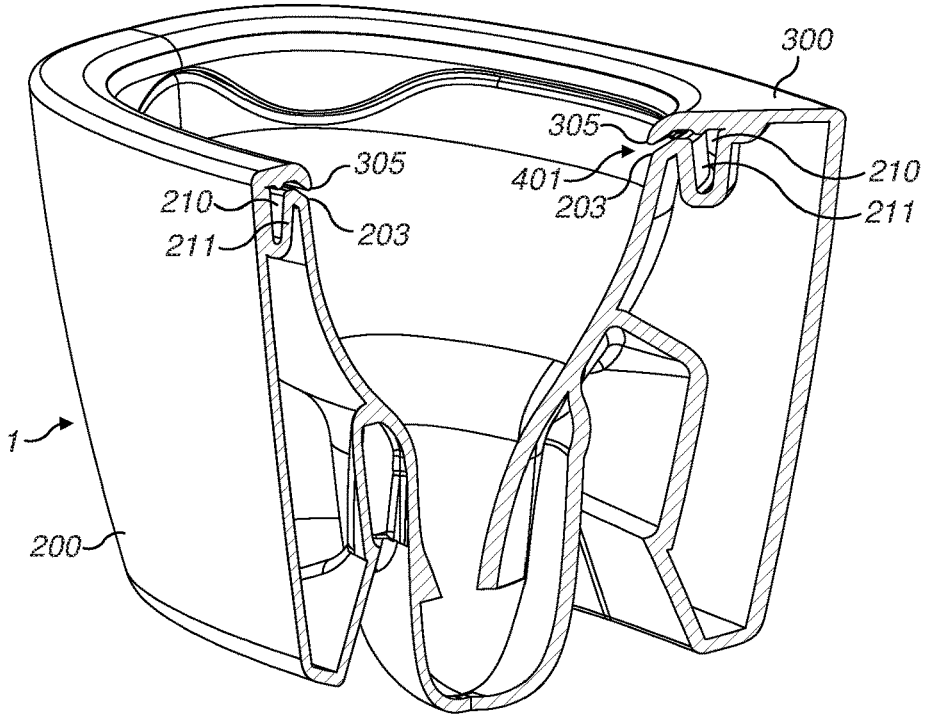
Figure 28:
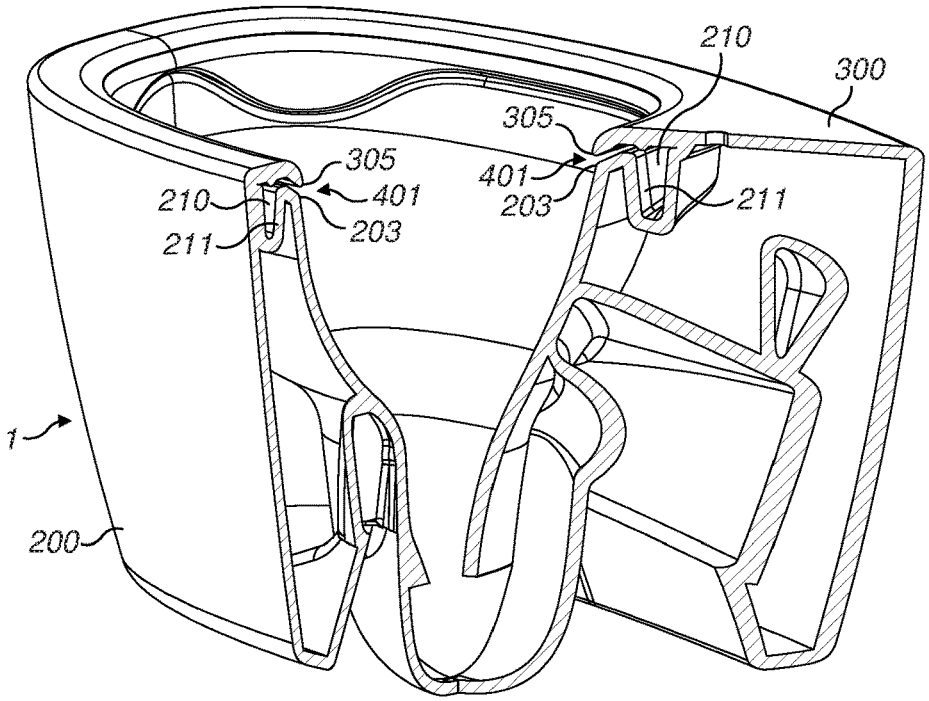
Figure 29:
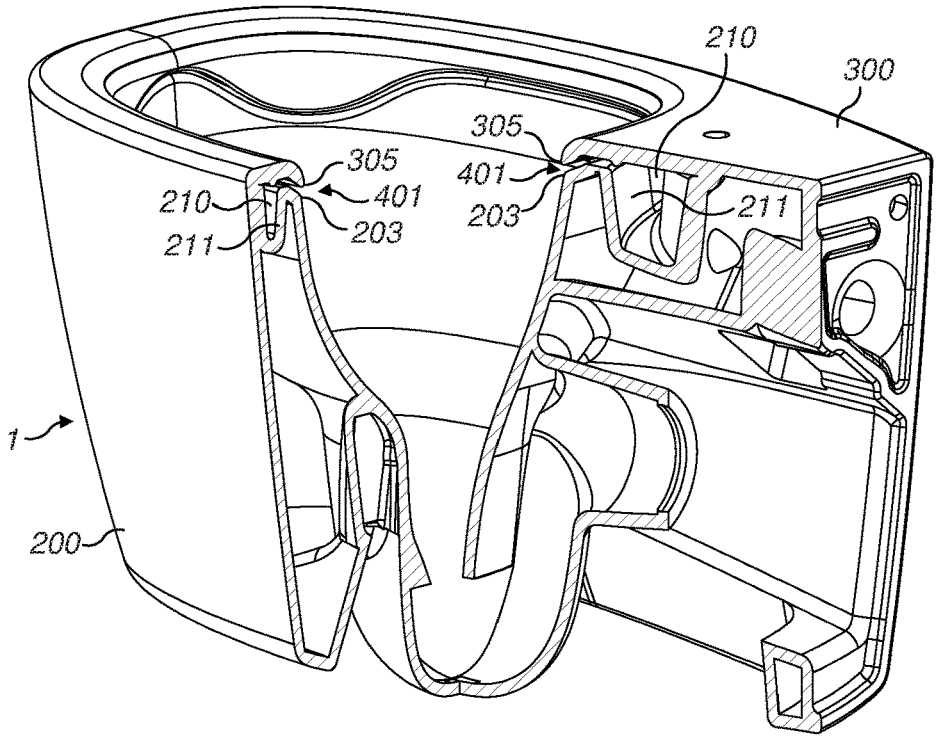
Figure 30:
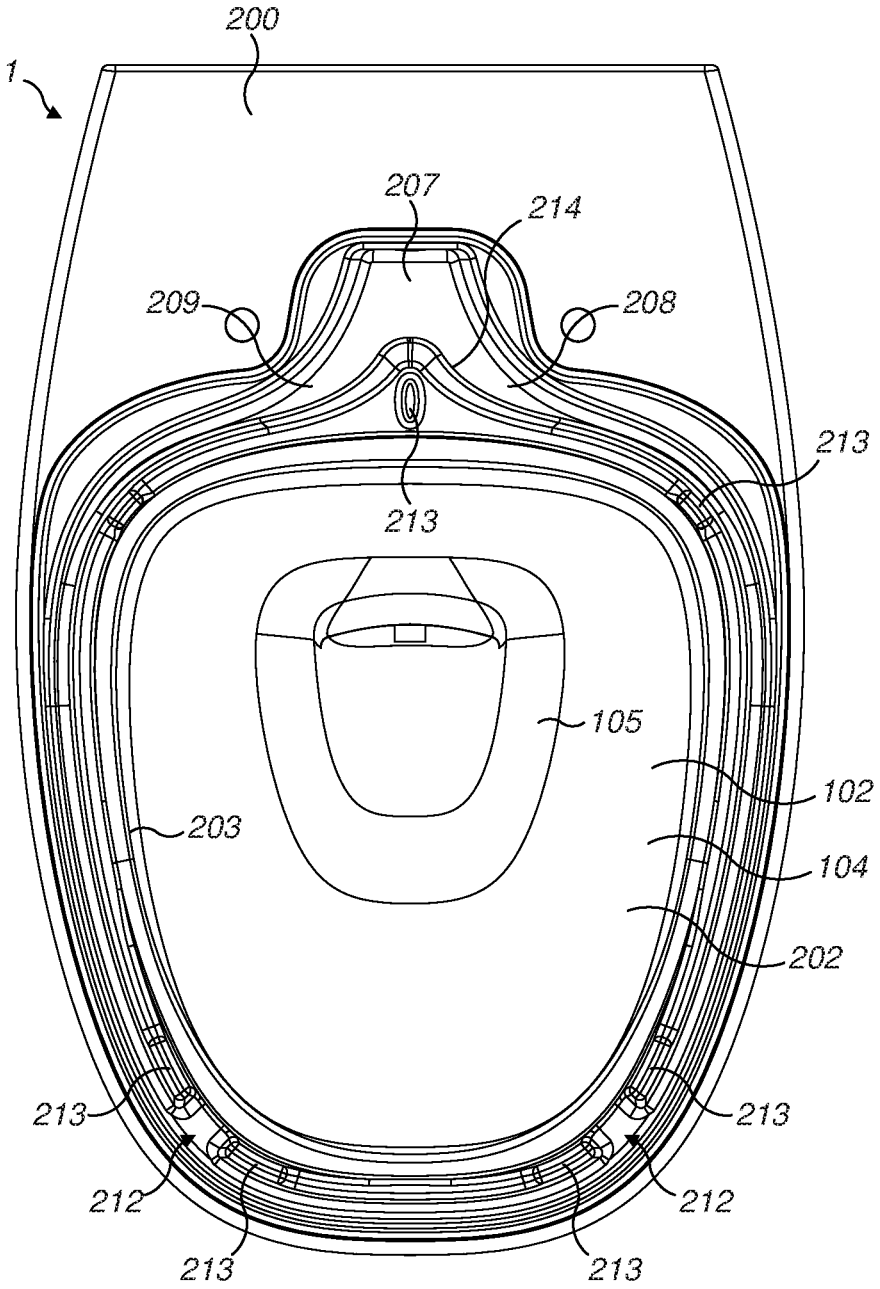
FIGS. 30 to 33 show the base unit of the toilet bowl unit (i.e. the toilet bowl unit omitting the top unit in the form of a lid or cover) as a plan view, rear perspective view, front perspective view and rear view from above.

At positions of the slot 400 between these two extremes, such as in FIGS. 16, 19 and 20, the passageway of the slot has a generally dog-legged configuration as the water flows over the weir, downwards and then radially inwards and downwards as the water navigates its way behind the lobe 306 and out into the toilet bowl 101.

Figure 37A:
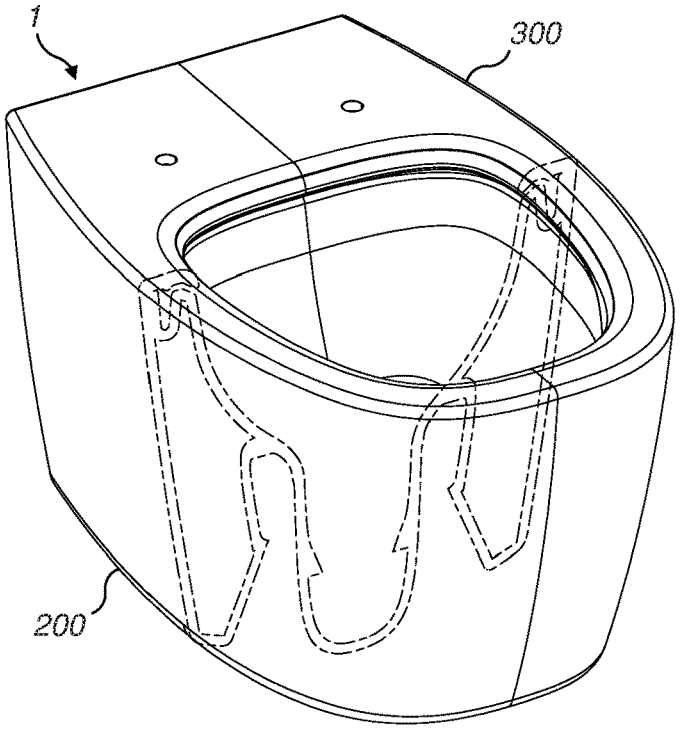
FIGS. 37A, 37B and 37C are similar to FIGS. 36A, 36B and 36C but show how the radius of curvature of upper and lower edges of the discharge opening of the slot are arranged to draw the curtain of water down onto the toilet bowl surface.
Figure 37B:
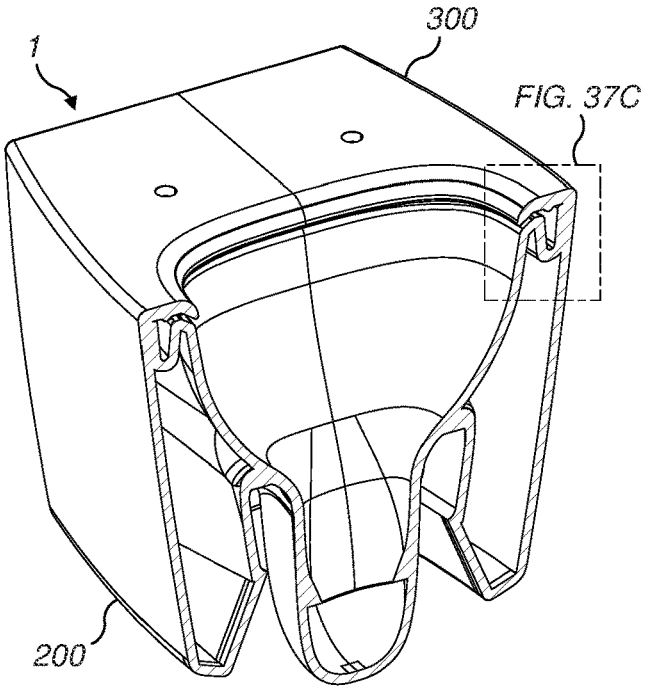
Figure 37C:
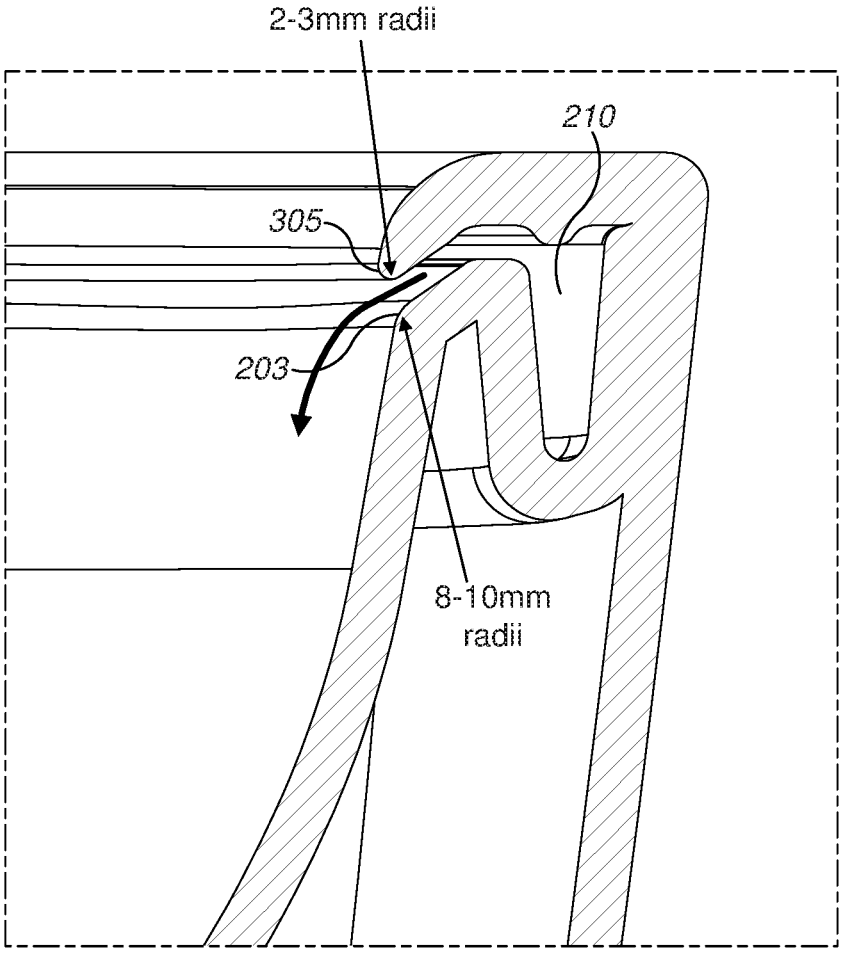

The exit or discharge opening 401 of the slot 400 usually has a height (depth from floor to roof of the opening) of 3 to 5 mm (see FIG. 36C). This gives the slot 400 a slim and uniform appearance.

Where the slot 400 produces a curtain of water at the horizontal portions of the slot, the radius of curvature of the lower edge 305 is usually 8 to 10 mm, and the radius of curvature of the upper edge 203 is usually 2 to 3 mm (see FIG. 37C). This helps the curtain of water, as it exits the opening 401, to cling to the wall of the central portion 104 as it flows down into the toilet bowl 101. In this way, the curtain of water can wash clean substantially all of the wall surface of the central portion 104.

The water streams which flow out of the slot 400 from underneath the two lobes 306 are powerful enough to leave the toilet bowl surface 102 and project into the central volume of the toilet bowl 101 in a generally rearwards and downwards direction. The two water streams collide to form a plume of water which drops down into the sump 204 to flush waste matter and water out of the sump 204 and through the sump outlet 205.

Because the slot 400 is annular and because water issues from the slot outlet 401 at all points around the circumference of the slot 400, the issued water (water curtain and water streams) washes clean all of the inner toilet bowl surface 102 that is below the level of the slot 400.

With the toilet bowl unit 1, in order to minimize the area of inner toilet bowl surface 102 which is not washed with water, because it is above the level of the slot 400, the height of the lower edge 305 below the top surface 302 of the plate 301 is usually set to be 18 to 20 mm (see FIG. 36C).

The slot angle of 25 to 30 degrees below the horizontal (see FIG. 36C) helps to direct the water downwards as well as radially inwards. This configuration helps to reduce splashing of the water out of the toilet bowl 101 during flushing.

The lower edge 305 is stepped radially inwards from the upper edge 203 (see FIG. 36C) by usually 2 to 5 mm. This gives the inner toilet bowl surface 102 an almost smooth appearance when viewed from a distance because the overhang (inward step) of the lower edge 305 is barely visible. It also improves visibility of the toilet bowl 101 when it is being manually cleaned by an operative and makes it less likely that any portion of the surface 102 will miss being scrubbed clean.

The water channel 210 is capped by the top unit 300 (see FIG. 35C) and has a typical width of 15 to 45 mm (including the opening 212 shown in FIG. 35C), and a typical height (depth) of 20 to 55 mm. The same height (depth) is used at other positions around the circumference of the toilet bowl 101 (e.g. see FIG. 36C) but the width of the channel 210 is less where the side wall 211 is present to form the discharge weir. The height (depth) may be greater (say the 55 mm value) at the rear of the toilet bowl unit 1 and may be lesser (say the 20 mm value) at the front of the toilet bowl unit 1. However, whilst the floor of the channel 210 may slope upwards to some extent from the rear to the front, the floor is generally flat or level on a macro scale.

A flush test is shown being performed on three toilets in FIGS. 38A to 40C.

Figure 38A:
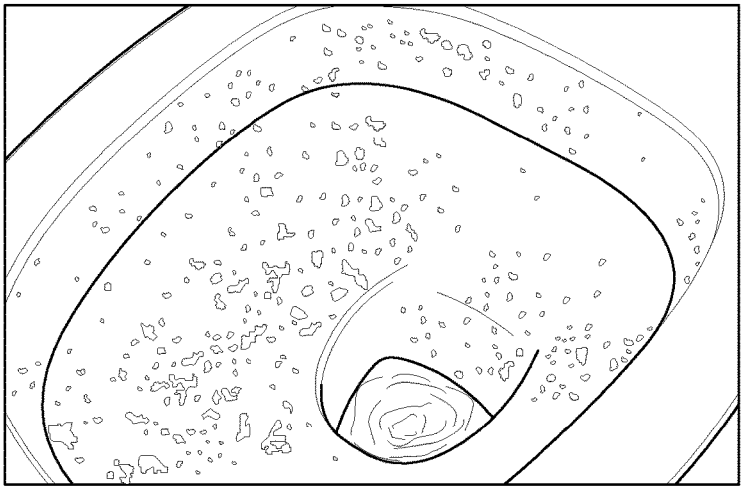
FIG. 38A (Prior Art)
FIGS. 38A, 38B and 38C are line drawings produced from photographs showing a flush test using colored sawdust on a prior art toilet of the traditional type having an overhanging rim channel.
Figure 38B:
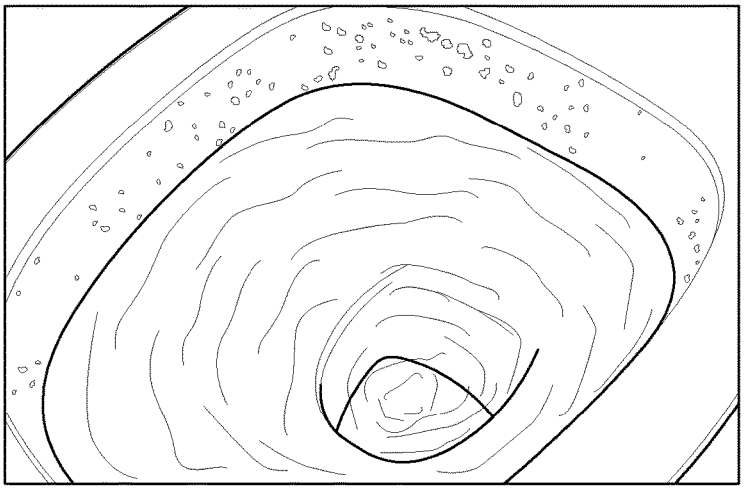
FIG. 38B (Prior Art)
Figure 38C:
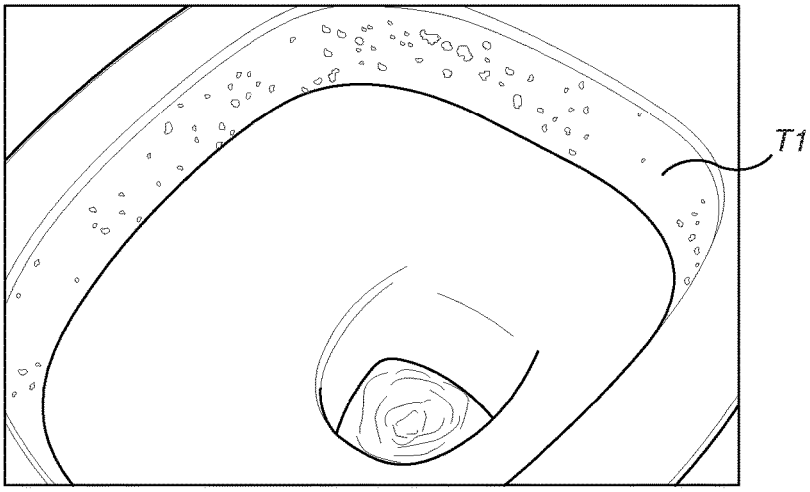
FIG. 38C (Prior Art)

The toilet being tested in FIGS. 38A, 38B and 38C is a prior art toilet of the traditional type having an overhanging rim channel. In FIG. 38A, colored sawdust has been applied inside the toilet bowl to simulate a used toilet. In FIG. 38B, the flushing occurs. FIG. 38C shows the completion of the test after the flushing has finished. From FIG. 38C, it may be seen that the toilet bowl surface below the overhanging rim channel is clean, but that the tall side wall T1 of the overhanging rim channel is still covered with sawdust.

Figure 39A:
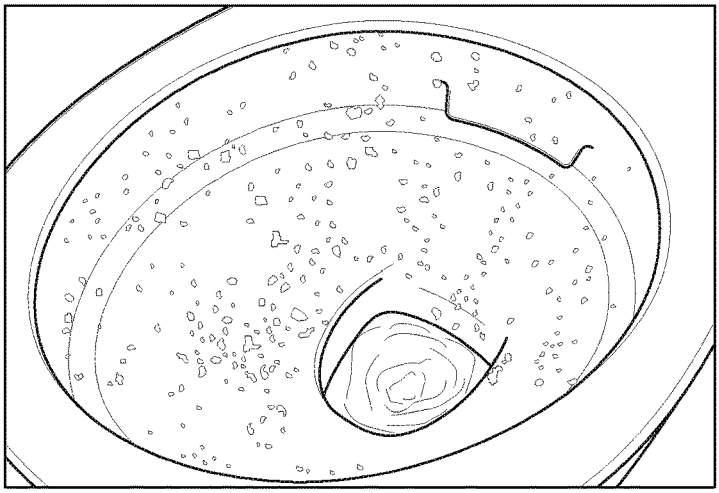
FIG. 39A (Prior Art)
FIGS. 39A, 39B and 39C are line drawings produced from photographs showing a flush test using colored sawdust on a prior art toilet of the "rimless" type.
Figure 39B:
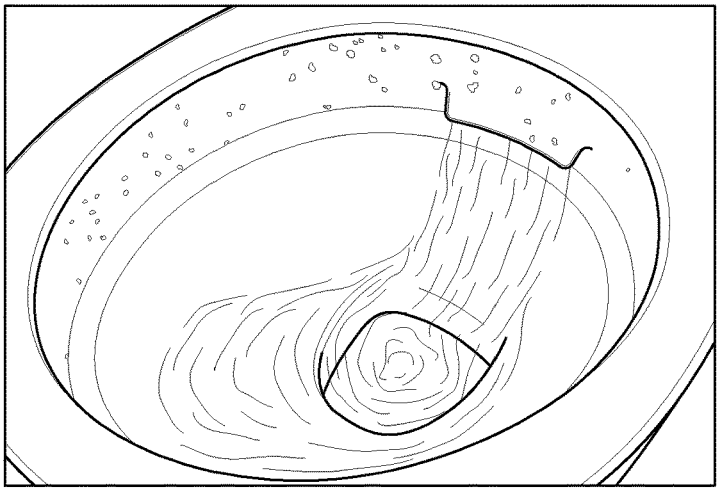
FIG. 39B (Prior Art)
Figure 39C:
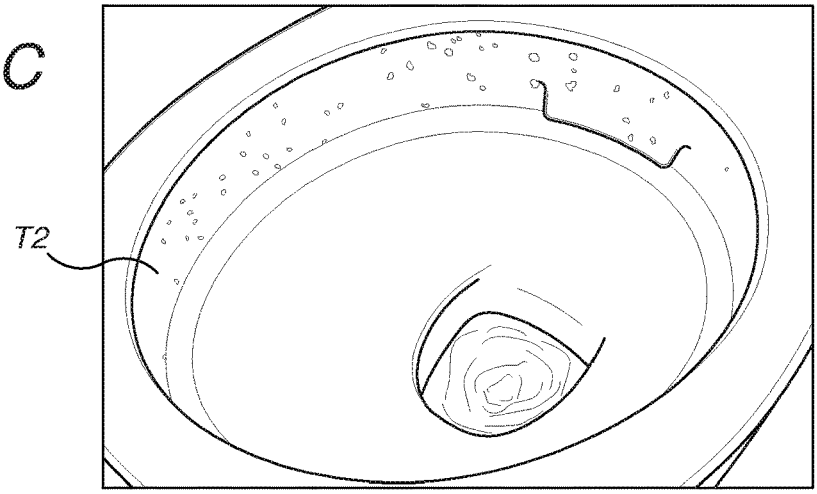
FIG. 39C (Prior Art)

The toilet being tested in FIGS. 39A, 39B and 39C is a prior art toilet of the "rimless" type. In FIG. 39A, colored sawdust has been applied inside the toilet bowl to simulate a used toilet. In FIG. 39B, the flushing occurs. FIG. 39C shows the completion of the test after the flushing has finished. From FIG. 39C, it may be seen that the toilet bowl surface below the annular ledge for guiding the flushing water is clean, but that the annular wall T2 above the guiding ledge is still covered with sawdust. Also, the water distribution feature at the rear of the guiding ledge is still covered with sawdust. In real life, the complex shape of the water distribution feature can make it difficult to keep it fully clean with manual cleaning.

Figure 40A:
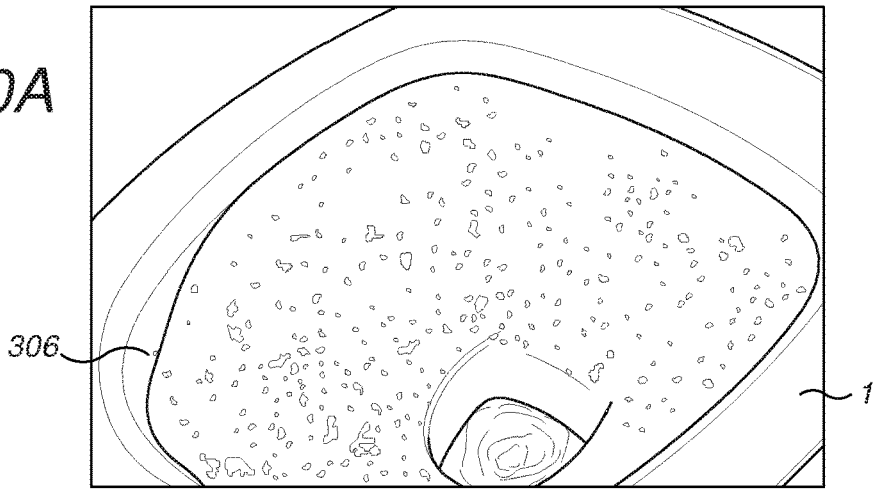
FIGS. 40A, 40B and 40C are line drawings produced from photographs showing a flush test using colored sawdust on a toilet having a toilet bowl unit in accordance with the present disclosure.
Figure 40B:
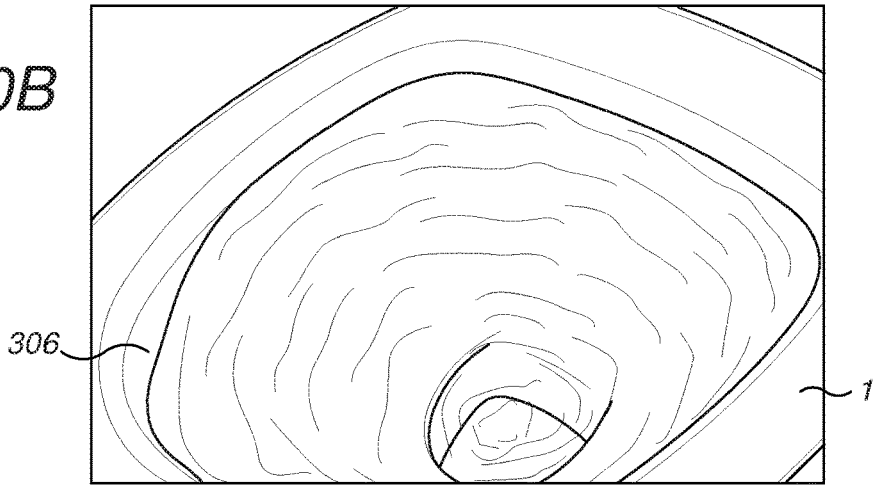
Figure 40C:
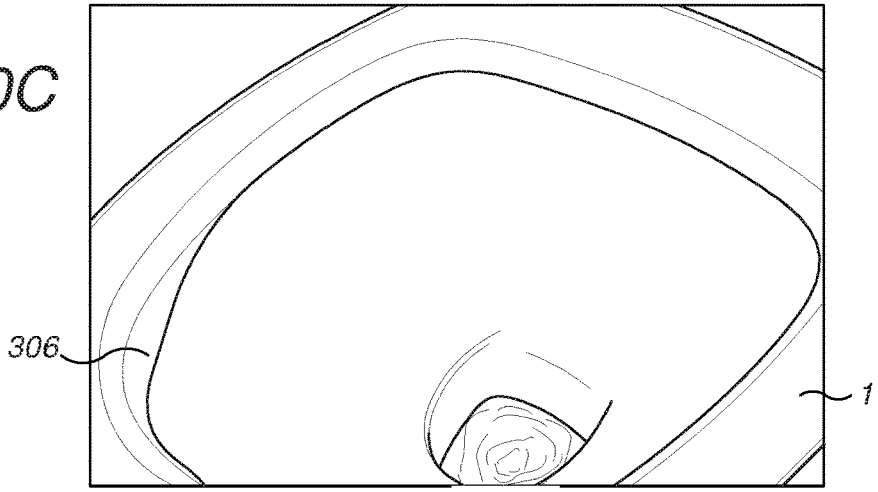

The toilet being tested in FIGS. 40A, 40B and 40C is a toilet having a toilet bowl unit 1 in accordance with the present disclosure. In FIG. 40A, colored sawdust has been applied inside the toilet bowl to simulate a used toilet. In FIG. 40B, the flushing occurs. FIG. 40C shows the completion of the test after the flushing has finished. From FIG.

40C, it may be seen that the toilet bowl surface below the annular flushing slot is clean. The height of the "rim", in the form of the downwardly-projecting wall and the lobes 306 of the top unit, is sufficiently small or shallow that the "rim" did not pick up any "splattered" sawdust at the beginning of the test during the sawdust-application phase. In real life, this means that the overall toilet bowl unit 1 is likely to remain inherently clean simply through flushing of the toilet. The need for manual cleaning is reduced.

Also, it has been found during tests of the toilet bowl unit 1 that the water flow (water curtain and water streams) during flushing rapidly becomes quieter than for prior art toilet bowl designs. In other words, the average noise level during the flush cycle is less.

It will be recognized that the various features, aspects and embodiments described and illustrated herein may be used in any convenient combination and constitute part of the invention.

The invention claimed is:

1. A toilet bowl unit comprising:

a toilet bowl with an inner toilet bowl surface having an upper peripheral portion, a central peripheral portion and a lower sump portion;

a peripheral slot having a discharge opening which separates a lower edge of the upper peripheral portion from an upper edge of the central peripheral portion; and a peripheral water channel which is concealed inside the toilet bowl unit and has a side wall which is a weir over which water may flow into the peripheral slot;

wherein the discharge opening of the peripheral slot includes at least one local downward deflection of the discharge opening, and the or each local downward deflection is a serpentine downward deflection which is positioned in a front half of the toilet bowl.

2. A toilet bowl unit according to claim 1, wherein the peripheral water channel is located radially outwards of an outer toilet bowl surface of the toilet bowl.

3. A toilet bowl unit according to claim 1, wherein the weir is located radially outwards of the outer toilet bowl surface of the toilet bowl.

4. A toilet bowl unit as claimed in claim 1, wherein the peripheral slot is annular.

5. A toilet bowl unit as claimed in claim 1, wherein the peripheral slot faces downwards and radially inwards into the toilet bowl.

6. A toilet bowl unit as claimed in claim 1, wherein the lower edge of the upper peripheral portion is stepped radially inwards from the upper edge of the central peripheral portion by 1 to 10 mm.

7. A toilet bowl unit as claimed in claim 1, wherein the peripheral slot has a depth between a roof and a floor of the slot at the discharge opening of the slot of between 1 mm and 10 mm.

8. A toilet bowl unit as claimed in claim 7, wherein the depth of the slot at all measurement points around the periphery of the inner toilet bowl surface does not vary by more than plus or minus 3 mm from an average slot depth value.

9. A toilet bowl unit as claimed in claim 1, wherein the discharge opening of the peripheral slot is substantially horizontal around at least 50% of the periphery of the inner toilet bowl surface.

10. A toilet bowl unit as claimed in claim 1, wherein the or each local downward deflection is defined by a lobe of the lower edge of the upper peripheral portion which projects down below substantially horizontal portion(s) of the discharge opening of the peripheral slot.

11. A toilet bowl unit as claimed in claim 1, wherein said at least one local downward deflection comprises first and second local downward deflections positioned at the front of the toilet bowl on respective sides of the toilet bowl.

12. A toilet bowl unit as claimed in claim 11, wherein the first and second local downward deflections are symmetrically positioned relative to a front to rear axis of the toilet bowl.

13. A toilet bowl unit as claimed in claim 1, wherein at the or each local downward deflection of the discharge opening a corresponding portion of the weir of the peripheral water channel has a locally reduced height.

14. A toilet bowl unit as claimed in claim 1, wherein the toilet bowl unit has a top surface which is a seat platform surface for supporting a toilet seat, and substantially horizontal portion(s) of the discharge opening of the peripheral slot are positioned 10 to 25 mm below the seat platform surface.

15. A toilet bowl unit as claimed in claim 1, wherein, at the discharge opening of the slot, the upper edge of the central peripheral portion of the inner toilet bowl surface has a greater radius of curvature in the vertical plane than the lower edge of the upper peripheral portion.

16. A toilet bowl unit as claimed in claim 1, comprising:

a base unit which provides the central peripheral portion and the lower sump portion of the inner toilet bowl surface; and a top unit which provides the upper peripheral portion of the inner toilet bowl surface;

wherein the top unit is joined to the base unit and the peripheral water channel is provided between the top unit and the base unit.

17. A toilet bowl unit as claimed in claim 16, wherein the top unit comprises a plate having an aperture surrounded by a downwardly-depending annular wall which provides the upper peripheral portion of the inner toilet bowl surface.

18. A toilet bowl unit as claimed in claim 1, wherein an inlet at the rear of the toilet bowl unit communicates with a manifold which communicates with two arms of the peripheral water channel.

19. A toilet bowl unit as claimed in claim 1, wherein the floor of the peripheral water channel is substantially horizontal in the circumferential direction of the toilet bowl.

* * * * *